US010805997B2

(12) United States Patent
Wang

(10) Patent No.: US 10,805,997 B2
(45) Date of Patent: Oct. 13, 2020

(54) METHODS AND APPARATUS FOR TRIAC-BASED DIMMING OF LEDS

(71) Applicant: Jie Dong Wang, Irvine, CA (US)

(72) Inventor: Jie Dong Wang, Irvine, CA (US)

(73) Assignee: DMF, Inc., Carson, CA (US)

( * ) Notice: Subject to any disclaimer, the term of this patent is extended or adjusted under 35 U.S.C. 154(b) by 0 days.

(21) Appl. No.: 16/841,362

(22) Filed: Apr. 6, 2020

(65) Prior Publication Data

US 2020/0236755 A1 Jul. 23, 2020

Related U.S. Application Data

(63) Continuation of application No. 16/561,898, filed on Sep. 5, 2019, now Pat. No. 10,616,968, which is a continuation of application No. PCT/US2019/014847, filed on Jan. 23, 2019.

(60) Provisional application No. 62/788,667, filed on Jan. 4, 2019, provisional application No. 62/620,884, filed on Jan. 23, 2018.

(51) Int. Cl.
*H05B 45/10* (2020.01)
*H05B 45/37* (2020.01)

(52) U.S. Cl.
CPC ..... *H05B 45/10* (2020.01); *H05B 45/37* (2020.01)

(58) Field of Classification Search
CPC ..... H05B 45/10; H05B 45/31; H05B 45/37; H05B 45/50; H05B 45/40; H05B 45/382; H05B 45/385; H05B 45/3575; H05B 47/10; Y02B 20/346; Y02B 20/347; H02M 3/156; H02M 3/33507; H02M 2001/0009
See application file for complete search history.

(56) References Cited

U.S. PATENT DOCUMENTS 8,278,832 B2 * 10/2012 Hung ..... H05B 45/10 315/219
8,344,657 B2 * 1/2013 Zhan ..... H05B 45/37 315/302

(Continued)

OTHER PUBLICATIONS

Thornton, Improve phase-cut dimming performance in LED luminaires (Magazine). Dec. 24, 2013. 4 pages.

(Continued)

*Primary Examiner* — Haissa Philogene
(74) *Attorney, Agent, or Firm* — Smith Baluch LLP

(57) ABSTRACT

Light output from an LED light source is increased or reduced in response to adjustment of a triac-based dimmer having a triac holding current to maintain conduction of the dimmer. An LED controller to control the light output includes a voltage-controlled impedance to provide an adaptive holding current that causes a triac current of the dimmer to be greater than the triac holding current, particularly when the dimmer is adjusted for significantly low light output (e.g., less than 5%, 2%, or 1% of full power light output). The adaptive holding current also allows for smooth increase of the light output starting from low light output, without perceivable flicker or shimmer. In one example, the voltage-controlled impedance is a resistive-like impedance that is placed on a secondary side of a transformer providing power to the LED light source. In another example, the voltage-controlled impedance is not pulse width modulated.

30 Claims, 14 Drawing Sheets

(56) References Cited

U.S. PATENT DOCUMENTS

| | | | | |
|---|---|---|---|---|
| 8,497,636 | B2 * | 7/2013 | Nerone | H05B 45/37 315/210 |
| 8,581,518 | B2 * | 11/2013 | Kuang | H05B 45/382 315/307 |
| 8,664,885 | B2 | 3/2014 | Koolen et al. | |
| 8,692,481 | B2 * | 4/2014 | Negrete | H05B 45/37 315/297 |
| 8,710,766 | B2 | 4/2014 | Kanamori et al. | |
| 8,829,819 | B1 * | 9/2014 | Angeles | H05B 45/37 315/308 |
| 8,922,129 | B1 | 12/2014 | Rodriguez | |
| 9,288,864 | B2 | 3/2016 | Wang et al. | |
| 9,674,904 | B2 | 6/2017 | Radermacher et al. | |
| 10,091,844 | B2 * | 10/2018 | Hu | H05B 45/14 |
| 10,616,968 | B2 | 4/2020 | Wang | |
| 2010/0090618 | A1 * | 4/2010 | Veltman | H05B 45/37 315/307 |
| 2011/0241557 | A1 | 10/2011 | Grotkowski et al. | |
| 2012/0188794 | A1 | 7/2012 | Chang et al. | |
| 2014/0159616 | A1 | 6/2014 | Wang et al. | |
| 2014/0265933 | A1 | 9/2014 | Melanson et al. | |
| 2015/0035450 | A1 * | 2/2015 | Werner | H05B 45/10 315/291 |
| 2016/0126860 | A1 | 5/2016 | Summerland | |
| 2016/0218626 | A1 | 7/2016 | Del Carmen | |

OTHER PUBLICATIONS

LED Driver with Phase-cut Dimmable Function, 8.6 W. Semiconductor Components Industries, LLC, Jan. 2018, 13 pages.

Fairchild Reference Design RD-523. 2015. Accessed at www.fairchildsemi.com. 11 pages.

LED Driver with Phase-cut Dimmable Function, 40 W. Semiconductor Components Industries, LLC, Feb. 2018, 13 pages.

Roggio, Dimming LEDs with Traditional TRIAC Dimmers. Digi-Key Electronics. Jul. 19, 2011. 2 pages.

Gu, Offl ine LED Lighting Simplifi ed: High Power Factor, Isolated LED Driver Needs No Opto-Isolators and is TRIAC Dimmer Compatible—Design Note 490. Linear Technology Design Notes. 2011. 2 pages.

Legates, Improving Line Regulation (and TRIAC Dimming) for the LT3799. Linear Technology Corportation. Jul. 11, 2011. 4 pages.

FL7734 Single-Stage Primary-Side_Regulation PWM Controller for PFC and Phase Cute Dimmable LED Driving. Nov. 2014. Fairchild Semiconductor Corporation. 13 pages.

International Search Report and Written Opinion in International Patent Application No. PCT/US19/14847 dated Jun. 6, 2019, 24 pages.

Notice of Allowance dated Dec. 27, 2019 from U.S. Appl. No. 16/561,898, 8 pages.

* cited by examiner

METHODS AND APPARATUS FOR TRIAC-BASED DIMMING OF LEDS

RELATED APPLICATIONS

The present application is a continuation application of U.S. application Ser. No. 16/561,898, filed Sep. 5, 2019, entitled "METHODS AND APPARATUS FOR TRIAC-BASED DIMMING OF LEDS," which is a bypass continuation of International Patent Application PCT/US2019/014847, filed Jan. 23, 2019, and entitled "METHODS AND APPARATUS FOR TRIAC-BASED DIMMING OF LEDS," which claims a priority benefit to U.S. provisional application Ser. No. 62/620,884, filed Jan. 23, 2018, and U.S. provisional application Ser. No. 62/788,667, filed Jan. 4, 2019, both entitled "METHODS AND APPARATUS FOR TRIAC-BASED DIMMING OF LEDS." Each of the above-identified applications is incorporated by reference herein in its entirety.

BACKGROUND

A phase-cut dimmer is a conventional electrical device designed as a simple, efficient, and inexpensive apparatus to adjust a light output of an incandescent light source (e.g., to allow for dimming). Such a dimmer operates by limiting the power delivered to the light source by only conducting current for a certain portion of each half-cycle of an AC line voltage. The dimmer may be adjusted (e.g., by turning a knob or changing the position of a slider) to vary the portion of the AC line voltage half-cycle during which the dimmer conducts current, thereby varying the power provided to the light source to increase or decrease the light output of the light source.

There are two different types of conventional phase-cut dimmers. A "leading-edge dimmer" delays the conduction period of the dimmer until after a zero crossing of the AC line voltage, thereby cutting out the initial portion of each half-cycle and conducting during the later portion of each half-cycle. In contrast, a "trailing-edge dimmer" operates in the opposite manner, i.e., conducting during the initial portion of each AC half-cycle after a zero crossing and cutting out during the later portion of each half-cycle. Leading-edge dimmers are generally used for inductive loads (e.g., magnetic low voltage transformers) whereas trailing-edge dimmers are generally used for capacitive loads (e.g., electronic low voltage transformers, LED drivers). Both types of dimmers may be used for resistive loads (e.g., incandescent lights).

Leading-edge dimmers are generally less expensive and have a more simple design than trailing-edge dimmers, and are conventionally used to adjust the light output of incandescent and halogen bulbs. These types of dimmers employ a triac switch to control the power provided to a light source, and hence are often referred to as "triac-based dimmers" or simply "triac dimmers." Triac-based dimmers are the most common type of dimmers conventionally used for dimming light sources.

FIG. 1 illustrates a conventional triac-based dimmer 100, showing an input AC line voltage $V_{LINE}$ 105 and a dimmer output $V_{DIM}$ 110. The dimmer 100 includes a triac, a diac coupled to a gate of the triac, a resistor R1, a capacitor C, and an adjustable resistor R2 (which facilitates an adjustment of the dimmer to vary the dimmer output 110, via a knob or slider for example). In FIG. 1, when the dimmer 100 is connected to the AC line voltage 105, the voltage $V_{DIM}$ charges the capacitor C to a voltage $V_{RC}$ by conducting current through the adjustable resistor R2 and the resistor R1. When $V_{RC}$ reaches a breakover voltage of the diac, a voltage is applied to the gate of the triac and the triac begins conducting the current $I_{TRIAC}$ 115. The resistance of the adjustable resistor R2 determines the time required to charge the capacitor C to the diac breakover voltage (e.g., a smaller resistance for R2 results in faster charging times for capacitor C, and a larger resistance for R2 results in slower charging times for capacitor C). Accordingly, the resistance of R2 determines when the triac begins conducting the current $I_{TRIAC}$ during each half-cycle of the AC line voltage, and thus adjusting the resistance of R2 varies the power provided by the dimmer output 110.

FIG. 2 illustrates the input line voltage 105, the dimmer output 110, the triac current $I_{TRIAC}$ 115 and a triac holding current $I_{HOLD}$ 120 of the triac-based dimmer 100 of FIG. 1. In FIG. 2, the resistor R2 is adjusted such that the triac begins to conduct the triac current $I_{TRIAC}$ 115 and provide the dimmer output $V_{DIM}$ 110 after a zero crossing and during the first half of a half-cycle of the AC line voltage 105. As also shown in FIG. 2, the triac stops conducting the triac current $I_{TRIAC}$ 115, and the dimmer output $V_{DIM}$ 110 goes to zero, when the triac current $I_{TRIAC}$ 115 is less than the triac holding current $I_{HOLD}$ 120 (the triac holding current is thus defined as the minimum current at which the triac conducts current). Conventional triac-based dimmers from a variety of manufacturers may have triac holding currents that vary significantly from manufacturer to manufacturer and model to model; for example, for an AC line voltage 105 having a nominal value of about 120 $V_{RMS}$ (plus or minus 10%), the triac holding current $I_{HOLD}$ 120 for a given triac-based dimmer 100 may be in a range of from about 5 milliamperes (mA) to 20 mA.

FIG. 3 illustrates example waveforms of a rectified dimmer output voltage 125 (in which the dimmer output 110 is applied to a rectifier to invert alternate half-cycles and thereby provide the rectified dimmer output voltage 125). As shown in FIG. 3, the rectified dimmer output voltage 125 has different phase angles as the triac-based dimmer 100 of FIG. 1 is adjusted (i.e., as the resistance of the adjustable resistor R2 is adjusted). The point in each half-cycle at which the triac of the dimmer 100 begins to conduct triac current $I_{TRIAC}$ 115 (and thus provided the rectified dimmer output voltage 125) is conventionally referred to as the "firing angle" or the "conduction phase angle" (or simply "phase angle") of the dimmer. In FIG. 3, multiple waveforms are illustrated for comparison to show different phase angles for different dimmer adjustments; on the left of FIG. 3, there is a full rectified waveform of the AC line voltage (corresponding to a theoretical phase angle of 180 degrees). Immediately to the right of this waveform, a dimmer adjustment is shown that results in a phase angle of 135 degrees (in which the first 45 degrees of each half-cycle is "cut off" when there is no triac current $I_{TRIAC}$ 115). FIG. 3 also shows additional waveform examples corresponding to phase angles of 100 degrees and 30 degrees, respectively (which provide relatively lower power from the dimmer).

As with the triac holding current, conventional triac-based dimmers from a variety of manufacturers may have maximum and minimum phase angles that vary significantly from manufacturer to manufacturer and model to model; consequently, the range of conduction periods and power delivered to a load may vary from dimmer to dimmer. For example, minimum phase angles for conventional triac-based dimmer may be in a range from 17 degrees to 72 degrees, and maximum phase angles may be in a range of from 104 degrees to 179 degrees.

It is conventionally difficult to effectively dim an LED light source to relatively low light output levels with triac-based dimmers that were originally intended for incandescent lights. Triac-based dimmers are not readily compatible with LEDs since LEDs do not appear as a resistive load. Accordingly, a problem for LED light sources employed in retrofit light fixtures intended to replace older incandescent fixtures is that often there are triac-based dimmers already installed in the environment for dimming of the legacy light fixture(s)—and these triac-based dimmers may not function appropriately with the replacement/retrofit LED light sources.

An LED driver generally is required in (or in connection with) a light fixture including an LED light source to provide power to the LEDs from a conventional source of wall power (e.g., an AC line voltage, 120 $V_{RMS}$/60 Hz). There are conventional LED driver solutions that allow for triac-based dimmers to be used with LED light sources. These conventional LED drivers generally provide adjustment of the output power to an LED light source using pulse width modulation of a power converter (e.g., a buck converter or a flyback converter). Examples of conventional LED drivers that allow for triac-based dimming of LED light sources employ specialized integrated circuits provided by various manufacturers, examples of which include the National Semiconductor LM3450, the Texas Instruments TPS92210, the Linear Technology LT3799 and the Fairchild/ON Semiconductor FL7734.

FIG. 4 is a block diagram of a conventional single-stage primary-side-regulation pulse-width-modulation-controlled LED driver for use with a triac-based dimmer, and FIG. 5 is a circuit diagram for the conventional LED driver shown in FIG. 4 based on the Fairfield/ON Semiconductor FL7734 integrated circuit. Details of the LED driver shown in FIGS. 4 and 5 may be found in the ON Semiconductor technical documentation entitled "LED Driver with Phase-Cut Dimmable Function, 8.6W," Publication Order No. TND6251/D, dated January 2018, and the Fairchild/ON Semiconductor technical documentation entitled "FL7734 Single-Stage Primary-Side-Regulation PWM Controller for PFC and Phase Cut Dimmable LED Driving," Publication FL7734, Rev 1.0, dated November 2014, both of which publications are hereby incorporated by reference herein in their entirety.

As shown in the block diagram of FIG. 4, the conventional LED driver employing the FL7734 integrated circuit is employed to control (increase or decrease) a light output 2052 of an LED light source 2050 (e.g., including one or more LEDs) via adjustment of the triac-based dimmer 100, which provides the triac current $I_{TRIAC}$ 115 and the dimmer output 110. An EMI filter and surge protection circuit 200 is employed to attenuate common mode and differential mode noise that may be generated within the driver, as well as to provide transient voltage suppression by attenuating line surges and electrical fast transients (e.g., in the AC line voltage). Rectifier 300 provides the rectified dimmer output voltage 125 based on the dimmer output 110.

In FIG. 4, the LED driver includes a power converter 600 (e.g., a flyback converter) that includes a transformer having a primary winding 612, a secondary winding 614, and an auxiliary winding 610 (e.g., to provide operating power for the FL7734 integrated circuit). The power converter also includes a snubber circuit 604 to suppress voltage spikes caused by the primary winding inductance during switching operation of the power converter (discussed below). The primary winding 612 is coupled to the rectified dimmer output voltage 125 (e.g., through a post EMI filter 500), and the secondary winding 614 provides an output power (e.g., low ripple DC average voltage and current) to the LED light source 2050 (via the operation of diode 606 and capacitor 608). Based on the configuration of the flyback power converter, an average output current 2054 (also referred to as "secondary-side current") generated in the secondary winding 614 of the transformer (and conducted by the LED light source 2050 to generate light output 2052) is related to an average primary current 150 (conducted through the primary winding 612 of the transformer) though a turns ratio of the primary winding and the secondary winding of the transformer.

The instantaneous current conducted through the primary winding 612 of the transformer of the flyback converter 600 in FIG. 4 is governed by a controllable switch 602 (e.g., a MOSFET) that receives a pulse-width-modulated (PWM) control signal (Gate) from a PWM controller 900 (which includes the FL7734 integrated circuit, as shown in FIG. 5). In general, the duty cycle of the PWM control signal provided to the switch 602 by the PWM controller 900 determines the magnitude of the average current 150 conducted on the primary side, which as noted above determines the average output current 2054 to the LED light source 2050 (via the turns ratio of the primary and secondary windings of the transformer). The duty cycle of the control signal provided by the PWM controller 900 depends on multiple factors, such as: 1) the dimmer output 110 (as sensed by the dimmer output voltage sensing block 700 to provide the sampled voltage $V_{IN}$ to the PWM Controller 900); 2) the current through the primary winding (as sensed by the primary current sensing block 1010 to provide the signal CS to the PWM Controller 900); and 3) the secondary-side output voltage across the LED light source (as sensed by the output voltage sensing block 1020, which divides a voltage across the auxiliary winding 610, representative of the voltage across the secondary winding 614, and provides the signal Vs to the PWM Controller 900). By way of example, a maximum value for the sampled dimmer voltage $V_{IN}$ is approximately 24 V, a maximum value for a peak voltage at CS is approximately 1.2 V, and a maximum value for the sensed voltage Vs is approximately 6 V. As noted above, the auxiliary winding 610 of the transformer also provides an operating voltage VDD for the PWM Controller 900 (a nominal value for VDD is in the range of 16-24V).

The conventional LED driver circuit shown in FIGS. 4 and 5 also includes a start-up active bleeder block 800 to facilitate rapid power-up operation of the PWM controller 900 during a power-on start-up sequence. In particular, the active bleeder block 800 couples the rectified dimmer output voltage 125 to the PWM controller operating voltage $V_{DD}$ (by quickly raising the Bias voltage from the PWM controller as soon as there is some dimmer output 100) to conduct a current through the start-up active bleeder for a short time (e.g., on the order of 4 to 5 half-cycles of the dimmer output). After this brief start-up sequence, the start-up active bleeder block is deactivated.

The circuit shown in FIGS. 4 and 5 also include a passive bleeder block 400 to provide a current path for a passive bleeder current 155 across the rectified dimmer output voltage 125 of the rectifier 300. As shown in FIG. 5, the passive bleeder block 400 across the output of the rectifier 300 includes a resistor and capacitor in series across the rectified dimmer output voltage 125; as noted in the ON Semiconductor technical documentation entitled "LED Driver with Phase-Cut Dimmable Function, 8.6W," Publication Order No. TND6251/D, dated January 2018, a nominal value for the resistor in the passive bleeder block 400 is 500 ohms and a nominal value for the capacitor in the passive bleeder block is 0.15 microfarads (150 nanofarads). The RC circuit of the passive bleeder block 400 provides a complex (frequency-dependent and non resistive-like) impedance across the output of the rectifier, including a resistive component and a capacitive component (reactance).

The conventional role of the passive bleeder block 400 in FIGS. 4 and 5 is to provide the passive bleeder current 155 as at least a portion of the triac current $I_{TRIAC}$ 115 in an effort to maintain the triac current $I_{TRIAC}$ above the triac holding current $I_{HOLD}$ 120. The passive bleeder current 155 is a more significant component of the overall triac current $I_{TRIAC}$ 115, particularly at lower light output levels (also referred to as "deeper dimming"), when the output current 2054 to the LED light source is relatively lower (and, accordingly, the average primary current 150 is relatively lower). As long as there is a dimmer output 110, however, the passive bleeder circuit 400 conducts some passive bleeder current 155, which performs essentially no salient function at relatively higher light output levels (when the average primary current 150 is significantly above the triac holding current); thus, under these circumstances, the passive bleeder block 400 continues to use power and decreases the efficiency of the driver.

SUMMARY

A general goal of the innovations disclosed herein is to facilitate replacement of legacy non-LED light fixtures (e.g., incandescent lights) controlled by triac-based dimmers with light fixtures including an LED light source. In various examples discussed below, existing triac-based dimmers from a variety of manufacturers (and different models from a given manufacturer) may be used to effectively control (increase or decrease) the light output of an LED light source in a relatively smooth fashion and over an appreciable range of light output (e.g., between full power light output and relatively small percentages of full power light output, such as less than 5%, less than 2%, or less than 1%).

The Inventor has recognized that as a triac-based dimmer is adjusted to reduce the light output of an LED light source to a significantly low level (e.g., around 5% of full power light output), some conventional LED drivers cause a shimmering or flickering effect to be observed by some viewers of the light output. Additionally, some conventional LED drivers simply cut off abruptly at some point as the triac-based dimmer is adjusted to lower the light output (e.g., at about 5% of full power light output, the LED driver stops providing output current to the LEDs and the light output abruptly cuts off). The Inventor has also observed that in instances in which light output abruptly cuts off (e.g., at about 5% of full power light output), a subsequent adjustment of the dimmer to try to increase the light output fails; instead, the light output remains at zero, and adjustment of the dimmer does not cause the light output to come back on. These issues are further complicated by the fact that there are a variety of different triac-based dimmer manufacturers, and respective dimmers from different manufacturers (or from the same manufacturer) may have different performance attributes and/or specifications from dimmer to dimmer that affect the performance of a given LED driver (with respect to shimmer/flicker effects, abrupt cut off of light output at relatively low dimming levels, and the inability to increase light output after decreasing to low dimming levels).

In view of the foregoing, the present disclosure relates to various innovations to improve the performance of an LED driver in conjunction with conventional triac-based dimmers to significantly mitigate shimmering or flickering effects and ensure an appreciable range of light output as the dimmer is adjusted to increase or reduce light output.

With reference to the conventional LED driver shown in FIGS. 4 and 5, the Inventor has recognized and appreciated that the passive bleeder 400 (including an RC complex impedance) not only introduces some degree of loss and inefficiency in the LED driver, but more significantly fails to provide an adequate passive bleeder current 155 at relatively low light output levels (e.g., below 5% full power light output, corresponding to the smallest phase angles of dimmer adjustment) to ensure that the triac current $I_{TRIAC}$ 115 is equal to or greater than the triac holding current $I_{HOLD}$ 120 for many conventional triac-based dimmers. This shortcoming is exacerbated by the fact that the triac holding current $I_{HOLD}$ for different triac-based dimmers may vary significantly from dimmer to dimmer (e.g., over a range of from 5 mA to 20 mA). Accordingly, conventional LED drivers, including the driver shown in FIGS. 4 and 5, are generally incapable of reliably providing flicker/shimmer-free dimming of an LED light source to light output levels below about 5% of full power light output, or below 2% of full power light output, or below 1% of full power light output, for a variety of conventional triac-based dimmers.

In various implementations discussed in greater detail below, to overcome the shortcomings of conventional LED drivers for use with a triac-based dimmer, inventive LED controllers according to the present disclosure comprise a controllable impedance to selectively and adaptively conduct an auxiliary holding current (also referred to herein as an "adaptive holding current"), particularly at significantly low light output levels of the LED light source (e.g., less than 5% of full power light output, less than 2% of full power light output, less than 1% of full power light output). This adaptive holding current facilitates the ability to maintain a triac current $I_{TRIAC}$ 115 in the triac-based dimmer that is equal to or greater than the triac holding current $I_{HOLD}$ 102, even at these very low light output levels. By controlling the impedance to conduct an adaptive holding current primarily (or exclusively) at significantly low light output levels, appreciable additional power loss or inefficiency in the LED driver is mitigated (unlike the passive bleeder 400 of the conventional driver shown in FIGS. 4 and 5, which introduces some power loss at all dimming levels).

In other aspects, the Inventor has recognized and appreciated that by providing the controllable impedance as a voltage-controlled impedance that resembles a resistance (also referred to herein as a "resistive-like impedance"), a smoother adaptive holding current may be provided to allow the LED driver and LED light source to more closely mimic the behavior of an incandescent light source when dimmed using a triac-based dimmer from relatively higher light output levels to significantly low light output levels. In various implementations discussed below, an impedance generation circuit (also referred to as a "holding current controller") including a controllable impedance (e.g., a voltage-controlled resistive-like impedance) may be placed on the primary side or the secondary side of a power converter of an LED driver to provide the adaptive holding current (which may contribute at least a portion of the total triac current $I_{TRIAC}$ 115 required to equal or exceed the triac holding current $I_{HOLD}$ 120). In some examples, the resistive-like impedance may be provided by a voltage-controlled oscillator driving a switched capacitor circuit, or by a junction field-effect transistor (JFET).

In other inventive implementations, a passive bleeder circuit similar to that shown and discussed above in connection with FIGS. 4 and 5 may also be employed together with an impedance generation circuit (or holding current controller) to provide another constituent component of a sufficient triac current. More specifically, the combination of a passive bleeder current, the adaptive holding current, and any output current to the LED light source (together with other incidental currents in the driver to ensure proper operation of the various components) ensures a sufficient triac current $I_{TRIAC}$, at significantly low light output, that is equal to or greater than the triac holding current $I_{HOLD}$. In this manner, the adaptive holding current provided by the inventive concepts disclosed herein may compensate for deficiencies in the passive bleeder current provided by conventional LED drivers that limit the effective dimming range of these conventional LED drivers. Instead, by virtue of the adaptive holding current, an enhanced dimming range and more reliable and smooth operation is realized, particularly at significantly low light power levels.

In yet other inventive implementations, an improved LED controller according to the present disclosure includes an over temp fold back circuit to reduce the current in the driver during relatively higher temperature conditions (e.g., at or above approximately 100 degrees C.) to safeguard against component/circuit failure at these temperature conditions. In another implementation, a PWM controller of an LED controller is modified to ensure a smooth transition between a current regulation open loop operation mode (at relatively lower driver output powers) and a constant voltage closed loop operation mode (at relatively higher driver output powers) to mitigate any perceivable discontinuity in the light output as the light output is increased or decreased via the adjustment of a triac-based dimmer.

In sum, one example inventive implementation is directed to an LED driver to increase or reduce light output from an LED light source in response to adjustment of a triac-based dimmer coupled to the LED driver. The LED driver comprises: a rectifier to provide a rectified voltage based on a dimmer output of the triac-based dimmer; a power converter, coupled to the rectifier, to provide output power for the LED light source based at least in part on the rectified voltage; and an impedance generation circuit, coupled to the power converter, to generate a voltage-controlled resistive-like impedance to provide an adaptive holding current for the triac-based dimmer, wherein the adaptive holding current significantly facilitates reduction in the light output of the LED light source, in response to the adjustment of the triac-based dimmer, to less than 5% of a full power light output of the LED light source.

Another example inventive implementation is directed to an LED driver to increase or reduce light output from an LED light source in response to adjustment of a triac-based dimmer coupled to the LED driver. The LED driver comprises: a rectifier to provide a rectified voltage based on a dimmer output of the triac-based dimmer; a power converter, coupled to the rectifier, to provide output power for the LED light source based at least in part on the rectified voltage; and an impedance generation circuit, coupled to the power converter, to generate a voltage-controlled resistive-like impedance to provide an adaptive holding current for the triac-based dimmer. The impedance generation circuit is controlled by an input voltage representing the dimmer output of the triac-based dimmer. The voltage-controlled resistive-like impedance increases as the input voltage increases so as to reduce the adaptive holding current. The voltage-controlled resistive-like impedance decreases as the input voltage decreases so as to increase the adaptive holding current. The adaptive holding current causes a triac current ($I_{TRIAC}$) of the triac-based dimmer to be greater than a triac holding current ($I_{HOLD}$) of the triac-based dimmer.

Another example inventive implementation is directed to an LED controller to control a light output of an LED light source in response to a dimmer output of a triac-based dimmer. The LED controller comprises a rectifier to provide a rectified voltage based on the dimmer output of the triac-based dimmer and a flyback converter comprising a transformer having a primary winding coupled to the rectified voltage and a secondary winding. The flyback converter further comprises a controllable switch coupled to the primary winding to control a primary winding current through the primary winding, and a diode and at least one capacitor coupled to the secondary winding to provide output power for the LED light source based at least in part on the triac-based dimmer output and the primary winding current. The LED controller further comprises a pulse width modulation (PWM) controller to control the controllable switch of the flyback converter, and a holding current controller, coupled to one of the primary winding and the secondary winding of the transformer of the flyback converter. The holding current controller includes a voltage-controlled impedance to provide an adaptive holding current for the triac-based dimmer. The voltage-controlled impedance is not pulse width modulated.

Another example inventive implementation is directed to a method for increasing or reducing light output from an LED light source in response to adjustment of a triac-based dimmer. The method comprises: A) generating an adaptive holding current for the triac-based dimmer via a voltage-controlled impedance coupled to a secondary winding of a transformer of a power converter providing power to the LED light source; and B) reducing the light output of the LED light source, in response to the adjustment of the triac-based dimmer and based at least in part on the adaptive holding current generated in A), to less than 5% of a full power light output of the LED light source.

Another example inventive implementation is directed to a method for increasing or reducing light output from an LED light source in response to adjustment of a triac-based dimmer. The method comprises: A) generating an adaptive holding current for the triac-based dimmer via a voltage-controlled impedance that is not pulse width modulated; and B) reducing the light output of the LED light source, in response to the adjustment of the triac-based dimmer and based at least in part on the adaptive holding current generated in A), to less than 5% of a full power light output of the LED light source.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

Following below are detailed descriptions of various concepts related to, and embodiments of, inventive methods and apparatus for triac-based dimming of LEDS. It should be appreciated that various concepts discussed herein may be implemented in multiple ways. Examples of specific implementations and applications are provided herein primarily for illustrative purposes.

In particular, the figures and example implementations described below are not meant to limit the scope of the present disclosure to the example implementations discussed herein. Other implementations are possible by way of interchange of at least some of the described or illustrated elements. Moreover, where certain elements of the disclosed example implementations may be partially or fully instantiated using known components, in some instances only those portions of such known components that are necessary for an understanding of the present implementations are described, and detailed descriptions of other portions of such known components are omitted so as not to obscure the salient inventive concepts underlying the example implementations.

Figure 5:
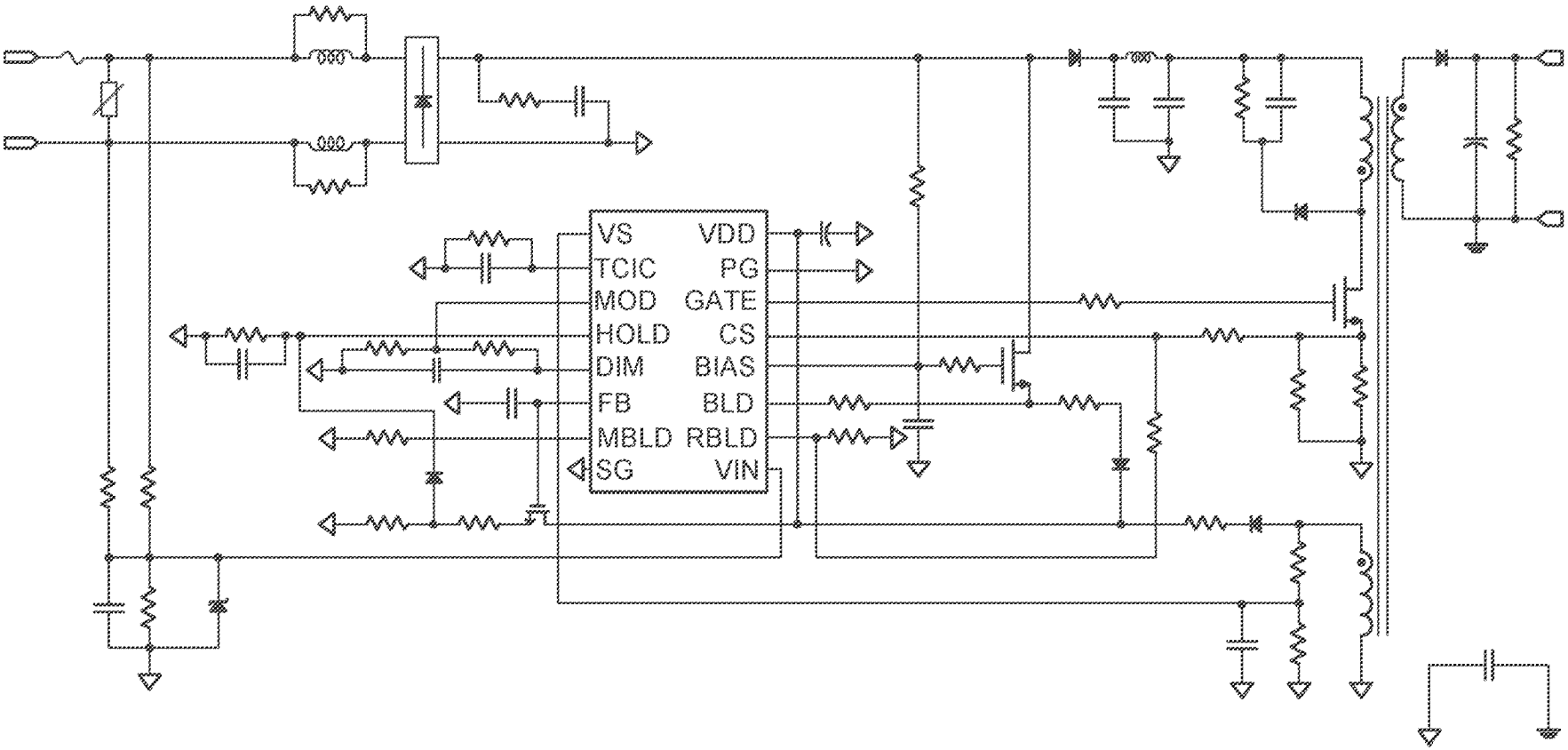
FIG. 5 (Prior Art)
FIG. 5 is a circuit diagram for the conventional LED driver shown in FIG. 4.
Figure 6:
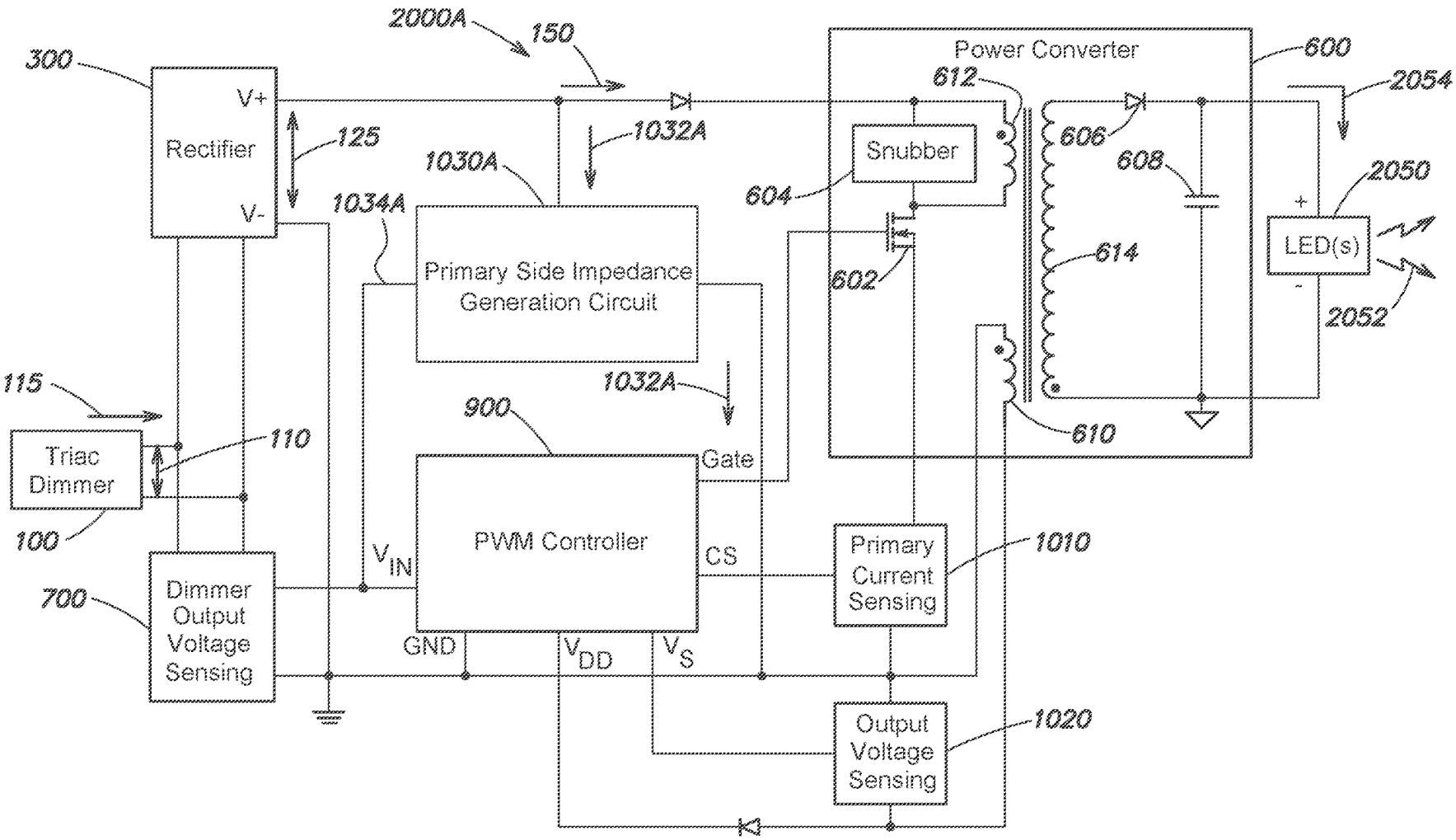
FIG. 6 is a block diagram of an LED controller for use with a triac-based dimmer according to one inventive implementation.
Figure 7:
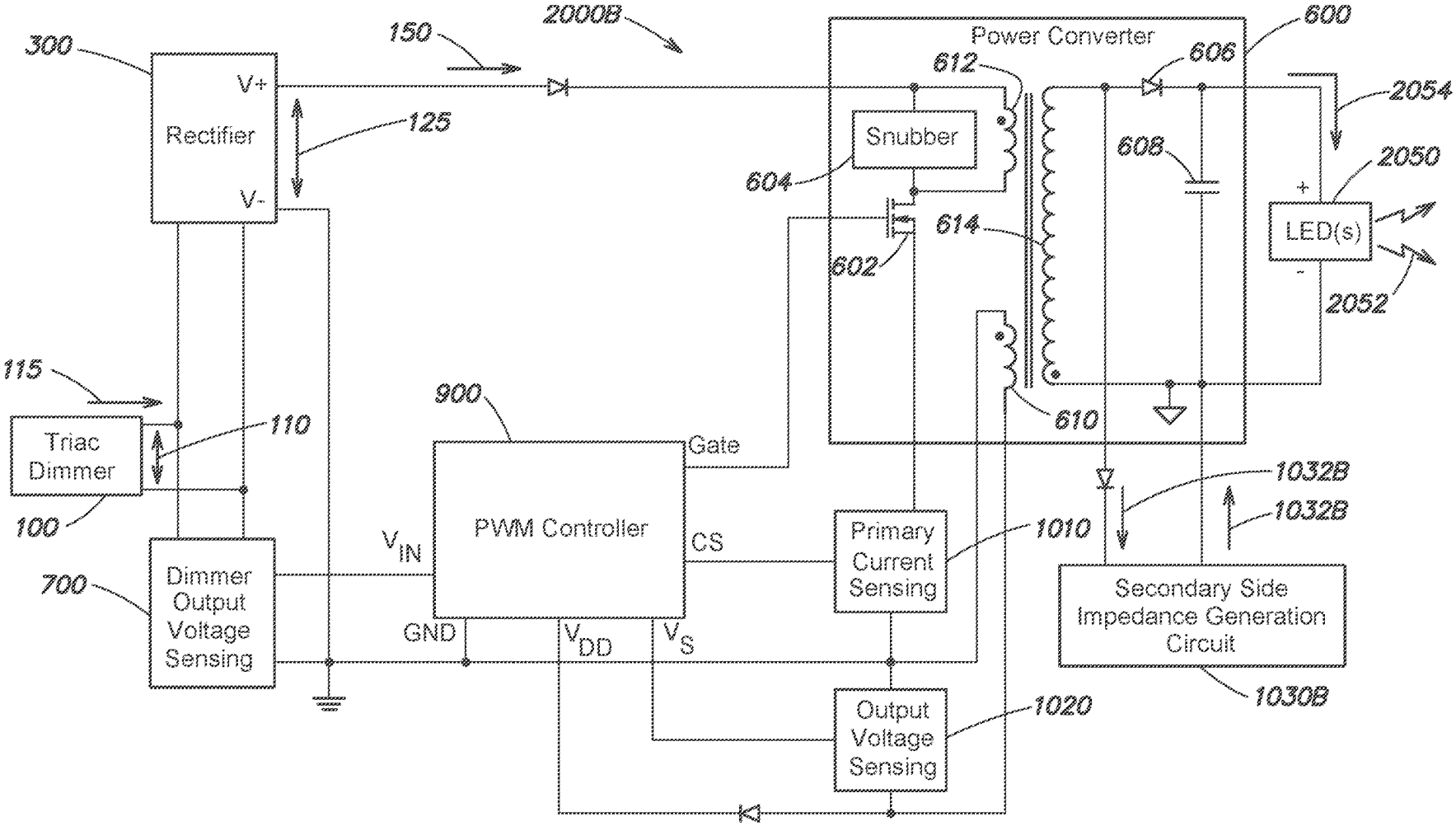
FIG. 7 is a block diagram of an LED controller for use with a triac-based dimmer according to another inventive implementation.

FIGS. 6 and 7 are respective block diagrams of LED controllers 2000A and 2000B for use with a triac-based dimmer 100, according to example inventive implementations. The LED controllers 2000A and 2000B may also be referred to as "LED drivers," and generally function to increase or reduce light output 2052 from an LED light source 2050 in response to adjustment of a triac-based dimmer 100, which provides the triac current $I_{TRIAC}$ 115 via the dimmer output 110. The LED controllers 2000A and 2000B are based in part on the LED driver shown in FIGS. 4 and 5; for example, like the LED driver shown in FIGS. 4 and 5, the LED controllers 2000A and 2000B of FIGS. 6 and 7 include a rectifier 300 to provide a rectified dimmer output voltage 125 based on the dimmer output 110 of the triac-based dimmer 100, and a power converter 600 to provide output power for the LED light source based at least in part on the rectified voltage 125. In the examples shown in FIGS. 6 and 7, the power converter 600 is shown as a flyback converter; however, it should be appreciated that other types of power converters (e.g., a boost converter, a buck converter) may be employed in LED controllers according to the inventive concepts disclosed herein for various light dimming applications utilizing one or more LED light sources.

As discussed above in connection with FIGS. 4 and 5, the power converter 600 of the LED controllers 2000A and 2000B includes a transformer having a primary winding 612, a secondary winding 614, and an auxiliary winding 610 (e.g., to provide operating power for the a PWM controller 900). The power converter also includes a snubber circuit 604 to suppress voltage spikes caused by the primary winding inductance during switching operation of the power converter (discussed below). The primary winding 612 is coupled to the rectified dimmer output voltage 125, and the secondary winding 614 provides an output power (e.g., via low ripple DC average voltage and output current 2054) to the LED light source 2050 (via the operation of diode 606 and capacitor 608).

Based on the flyback configuration of the power converter employing a transformer, an average output current 2054 (also referred to as "secondary-side current") generated in the secondary winding 614 of the transformer (and conducted by the LED light source 2050 to generate light output 2052) is related to an average primary current 150 (conducted through the primary winding 612 of the transformer) though a turns ratio of the primary winding 612 and the secondary winding 614 of the transformer. In particular, if $N_1$ represents the number of turns of the primary winding 612, $I_1$ represents the average primary current 150, $N_2$ represents the number of turns of the secondary winding 614, and 12 represents the output current 2054, the relationship between the primary current 150 and the output current 2054 is theoretically given as $N_1I_1=N_2I_2$, wherein $N_1/N_2$ is the turns ratio of the respective windings. In one example implementation discussed further below in connection with FIGS. 10-14, the turns ratio $N_1/N_2$ of the respective transformer windings is two, such that the average primary current 150 is essentially half of the output current 2054 (neglecting any relatively smaller currents in the controller to facilitate proper operation of the respective components).

Figure 4:
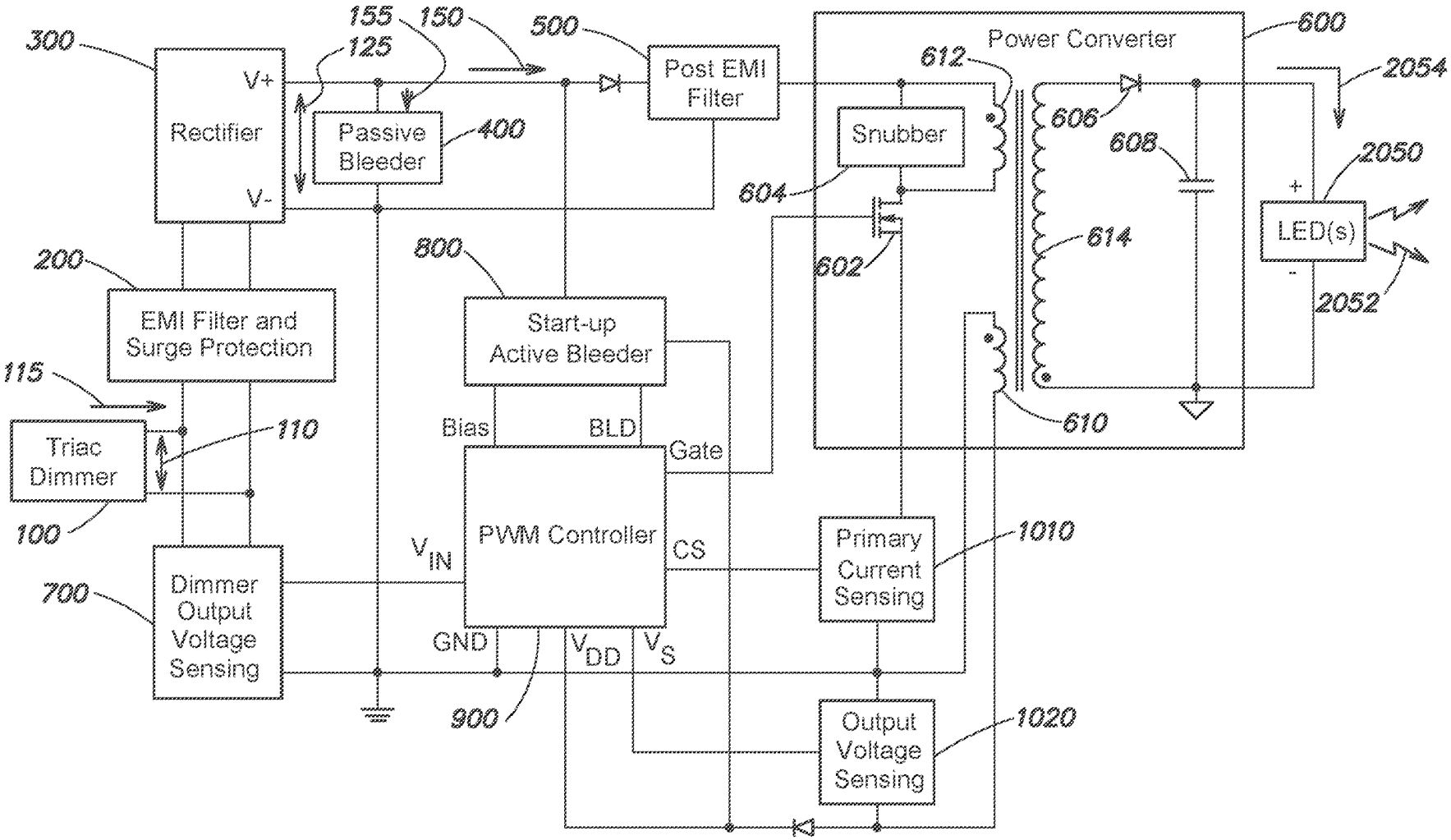
FIG. 4 (Prior Art)
FIG. 4 is a block diagram of a conventional single-stage primary-side-regulation pulse-width-modulation-controlled LED driver for use with a triac-based dimmer.
Figure 12:
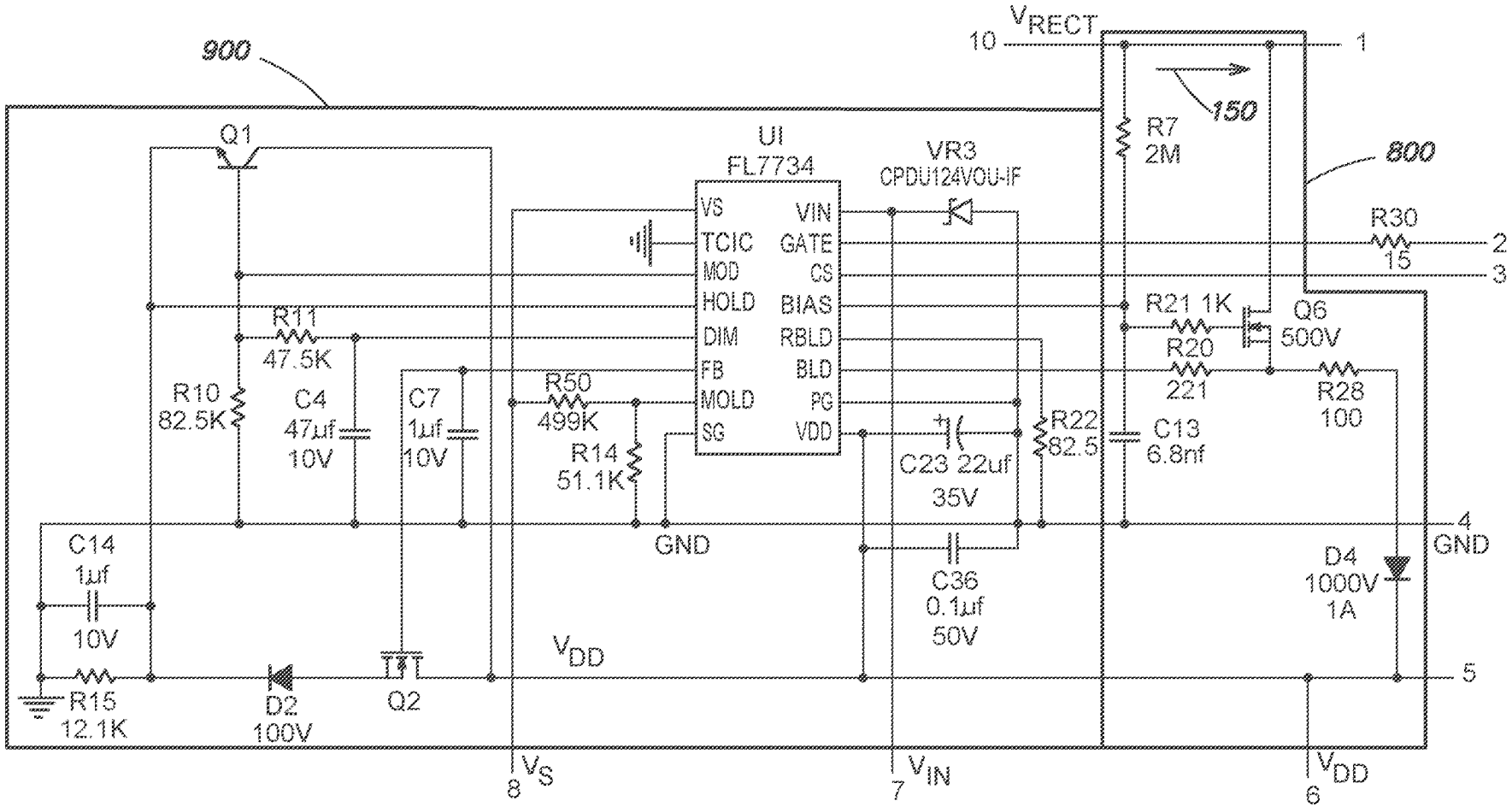
FIG. 12 is a circuit diagram for a second portion of the inventive circuit shown in FIG. 10, corresponding to a PWM controller block and a start-up active bleeder block as shown in FIG. 9.

As in FIGS. 4 and 5, the instantaneous current conducted through the primary winding 612 of the transformer of the flyback converter 600 in FIGS. 6 and 7 is governed by a controllable switch 602 (e.g., a MOSFET) that receives a pulse-width-modulated (PWM) control signal (Gate) from a PWM controller 900 (which in some inventive implementations may include the ON Semiconductor FL7734 integrated circuit, as shown in FIG. 12). In general, the duty cycle of the PWM control signal provided to the switch 602 by the PWM controller 900 determines the magnitude of the average current 150 conducted on the primary side, which as noted above determines the average output current 2054 to the LED light source 2050 (via the turns ratio of the primary and secondary windings of the transformer). The duty cycle of the control signal provided by the PWM controller 900 depends on multiple factors, such as: 1) the dimmer output 110 (as sensed by the dimmer output voltage sensing block 700 to provide the sampled voltage $V_{IN}$ to the PWM controller 900); 2) the current through the primary winding (as sensed by the primary current sensing block 1010 to provide the signal CS to the PWM controller 900); and 3) the secondary-side output voltage across the LED light source (as sensed by the output voltage sensing block 1020, which divides a voltage across the auxiliary winding 610, representative of the voltage across the secondary winding 614, and provides the signal Vs to the PWM controller 900).

Figure 1:
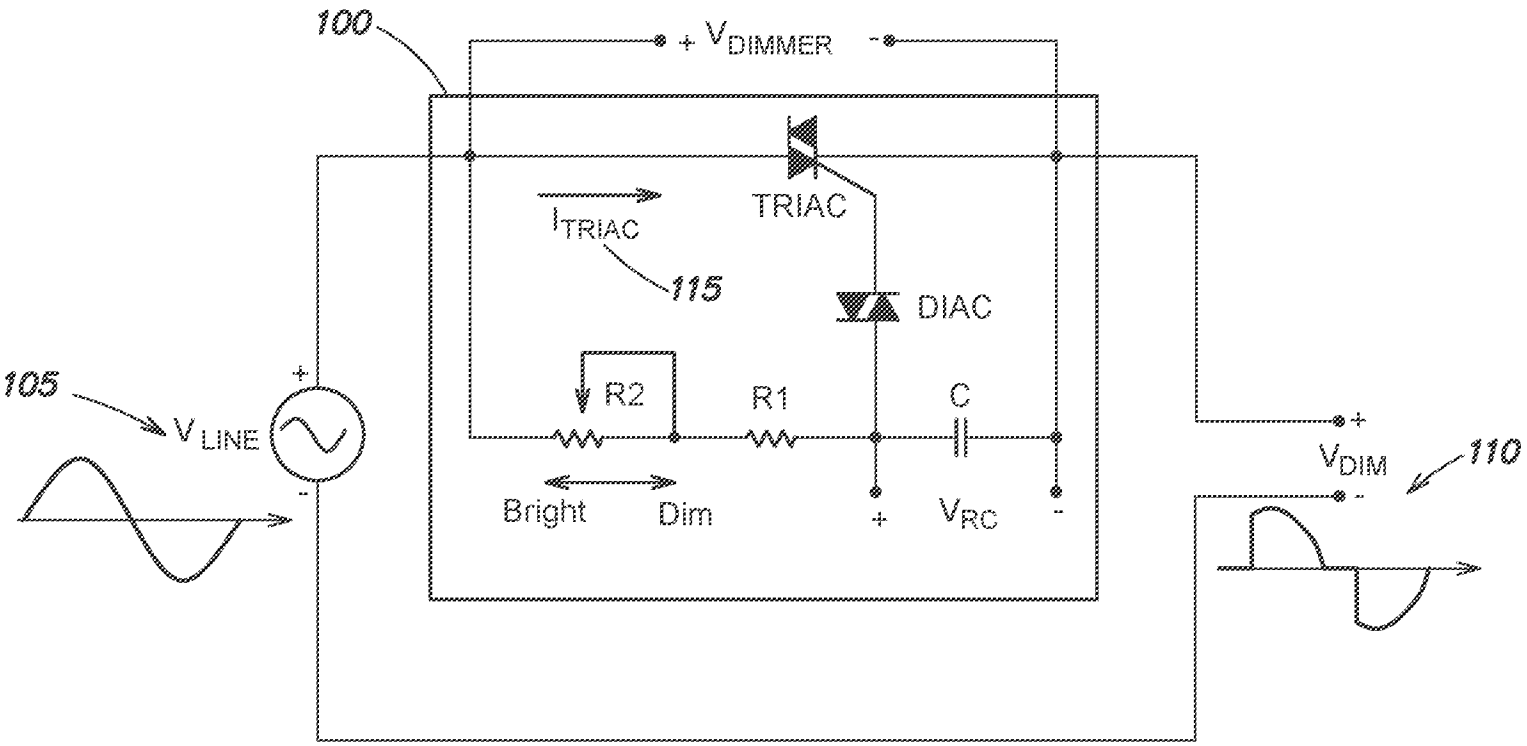
FIG. 1 (Prior Art)
FIG. 1 illustrates a conventional triac-based ("phase-cut") dimmer, showing an input line voltage and a dimmer output.
Figure 2:
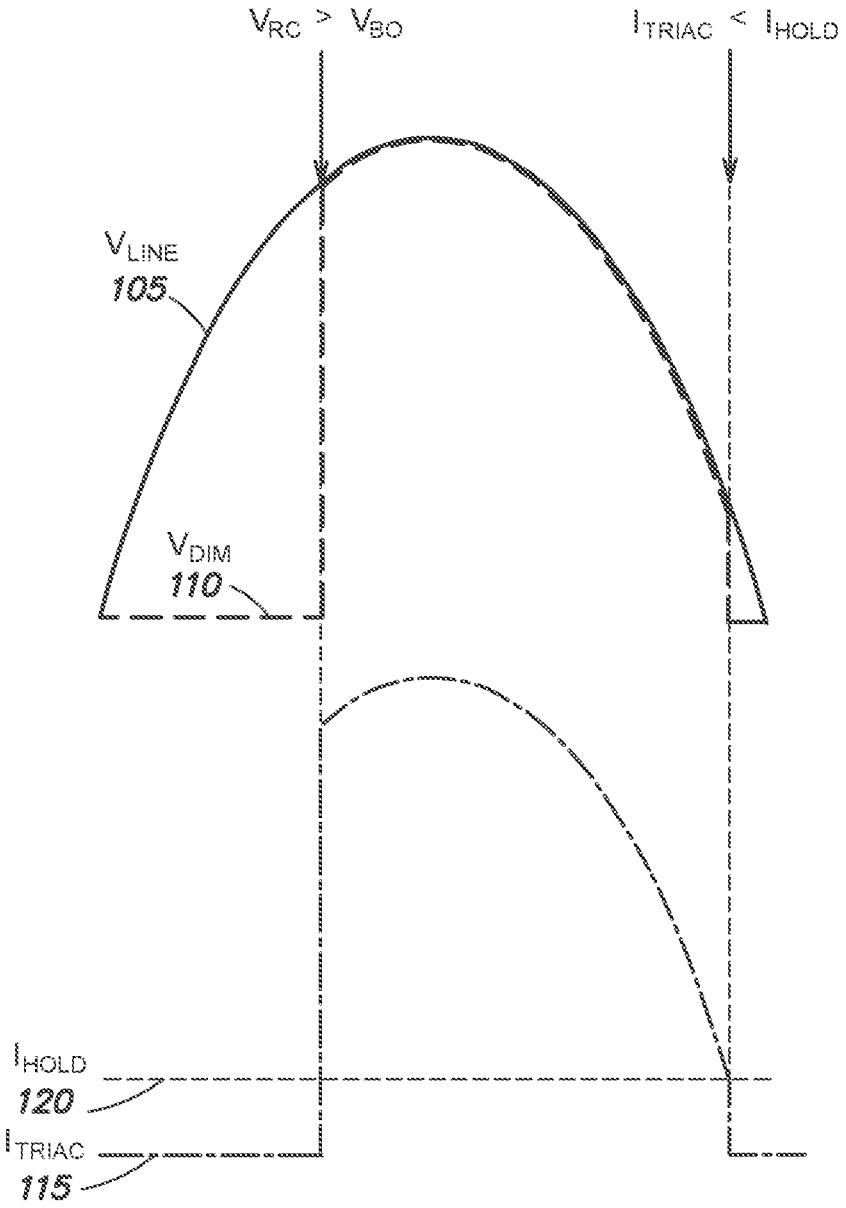
FIG. 2 (Prior Art)
FIG. 2 illustrates the input line voltage, the dimmer output, a triac current and a triac holding current of the triac-based dimmer of FIG. 1.
Figure 3:
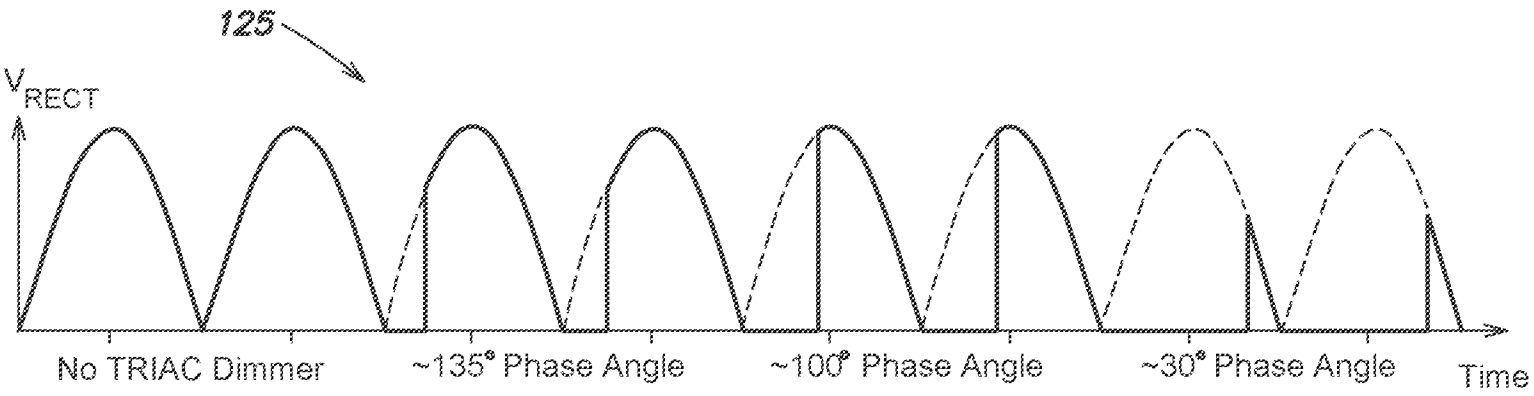
FIG. 3 (Prior Art)
FIG. 3 illustrates example waveforms of a rectified dimmer output voltage having different phase angles as the triac-based dimmer of FIG. 1 is adjusted.

By way of example, the triac-based dimmer 100 in FIGS. 6 and 7 may receive an A.C. line voltage of 120 $V_{RMS}$ (plus or minus 10%) and have an adjustment range to provide a dimmer output 110 with phase-cut waveforms having phase angles of between approximately 170 degrees (corresponding to full power light output 2052) and 20 degrees (corresponding to minimum light output 2052); some triac-based dimmers have adjustment ranges corresponding to phase angles of between approximately 135 degrees and approximately 30 degrees (e.g., see FIG. 3). Additionally, as noted above in connection with FIG. 2, the triac holding current $I_{HOLD}$ 120 for the triac-based dimmer 100 may be in a range of from approximately 5 mA to approximately 20 mA.

The inventive LED controllers 2000A and 2000B respectively shown in FIGS. 6 and 7 also include an impedance generation circuit (labeled as 1030A in FIG. 6, "Primary Side Impedance Generation Circuit;" and labeled as 1030B in FIG. 7, "Secondary Side Impedance Generation Circuit"), coupled to the power converter 600, to generate a controllable impedance (e.g., a voltage-controlled resistive-like impedance); this controllable impedance, appearing on either the primary side or the secondary side of the power converter 600, provides an adaptive holding current (labeled as 1032A in FIGS. 6 and 1032B in FIG. 7) for the triac-based dimmer 100. For the secondary side impedance generation circuit shown in FIG. 7, the controllable impedance and the adaptive holding current 1032B provided by the impedance generation circuit 1030B are "reflected" to the primary side (e.g., by virtue of the turns ratio of the primary winding 612 and the secondary winding 614 of the transformer).

In one aspect, the adaptive holding current 1032A or 1032B provided by the controllable impedance of the impedance generation circuit 1030A or 1030B significantly facilitates reduction in the light output 2052 of the LED light source 2050, in response to the adjustment of the triac-based dimmer 100, to less than 5% of a full power light output of the LED light source. In another aspect, the impedance generation circuit is controlled by a control voltage representing the dimmer output 110 of the triac-based dimmer 100. As shown in FIG. 6, for the primary side impedance generation circuit 1030A, the control voltage may be the voltage $V_{IN}$ provided by the dimmer output voltage sensing block 700. As shown in FIG. 7, for the secondary side impedance generation circuit 1030B, the control voltage may be derived from a secondary voltage across the secondary winding 614 (as discussed further below in connection with FIGS. 9-14).

In another aspect, the controllable impedance of the impedance generation circuit may be a voltage-controlled resistive-like impedance that increases as the control voltage increases so as to reduce the adaptive holding current 1032A or 1032B and decreases as the control voltage decreases so as to increase the adaptive holding current. In yet another aspect, the control voltage generally is not pulse width modulated (as in some conventional LED drivers) to control the resistive-like impedance to provide the adaptive holding current. As discussed in greater detail below, when present in the LED controllers 2000A and 2000B, the adaptive holding current 1032A or 1032B causes the triac current $I_{TRIAC}$ 115 of the triac-based dimmer 100 to be greater than a triac holding current $I_{HOLD}$ 120 of the triac-based dimmer. In particular, the adaptive holding current 1032A or 1032B causes the triac current $I_{TRIAC}$ 115 to be greater than the triac holding current $I_{HOLD}$ 120 when the adjustment of the triac-based dimmer causes the light output of the LED light source to be less than 5% of the full power light output of the LED light source, and more specifically less than 2% of the full power light output of the LED light source, and more specifically less than 1% of the full power light output of the LED light source.

Figure 8:
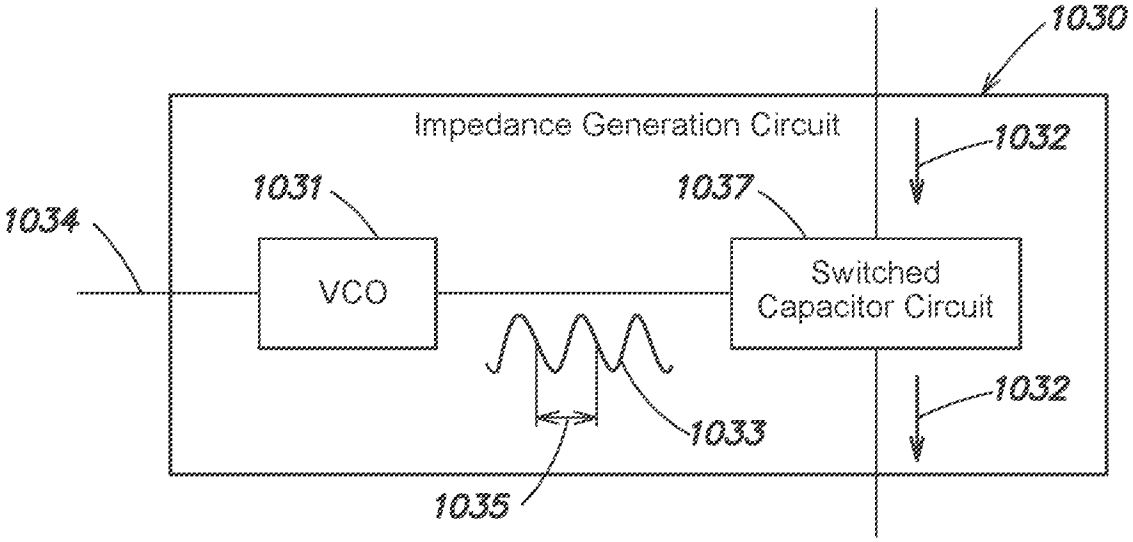
FIG. 8 is a block diagram of an impedance generation circuit that may be employed in the LED controller shown in FIG. 6 or FIG. 7, according to inventive implementations.

FIG. 8 is a block diagram of an impedance generation circuit 1030 that may be employed in the LED controller shown in FIG. 6 or FIG. 7 as either the primary side impedance generation circuit 1030A or the secondary side impedance generation circuit 1030B, according to inventive implementations. In FIG. 8, the impedance generation circuit 1030 includes a voltage-controlled oscillator (VCO) 1031, controlled by an control voltage 1034 (representing the dimmer output 110 of the triac-based dimmer 100) to generate a waveform 1033 having a frequency 1035 based on the control voltage 1034. The impedance generation circuit 1030 also includes a switched capacitor circuit 1037, coupled to the VCO 1031, to generate the resistive-like impedance based on the frequency 1035 of the waveform 1033 generated by the VCO 1031.

In various aspects of the impedance generation circuit 1030 shown in FIG. 8, the frequency of the waveform generated by the VCO increases as the control voltage to the VCO decreases, and the resistive-like impedance generated by the switched capacitor circuit decreases as the frequency of the waveform generated by the VCO increases; this has the effect of increasing the adaptive holding current 1032. Conversely, the frequency of the waveform decreases as the control voltage increases, and the resistive-like impedance generated by the switched capacitor circuit increases as the frequency of the waveform decreases; this has the effect of decreasing the adaptive holding current 1032. Thus, generally speaking, as the phase angle and power provided by the dimmer output 110 increases (e.g., as represented by the control voltage 1034) and correspondingly the primary current 150 increases, the adaptive holding current 1032 decreases (because arguably it is not required to ensure that the triac current is equal to or greater than the triac holding current at higher values of the primary current 150). Conversely, as the phase angle and power provided by the dimmer output 110 decreases (e.g., as represented by the control voltage 1034) and correspondingly the primary current 150 decreases, the adaptive holding current 1032 increases to contribute to the overall current being drawn through the triac-based dimmer, and thereby ensure that the triac current is equal to or greater than the triac holding current to facilitate deep dimming of the light output 2052.

Figure 9:
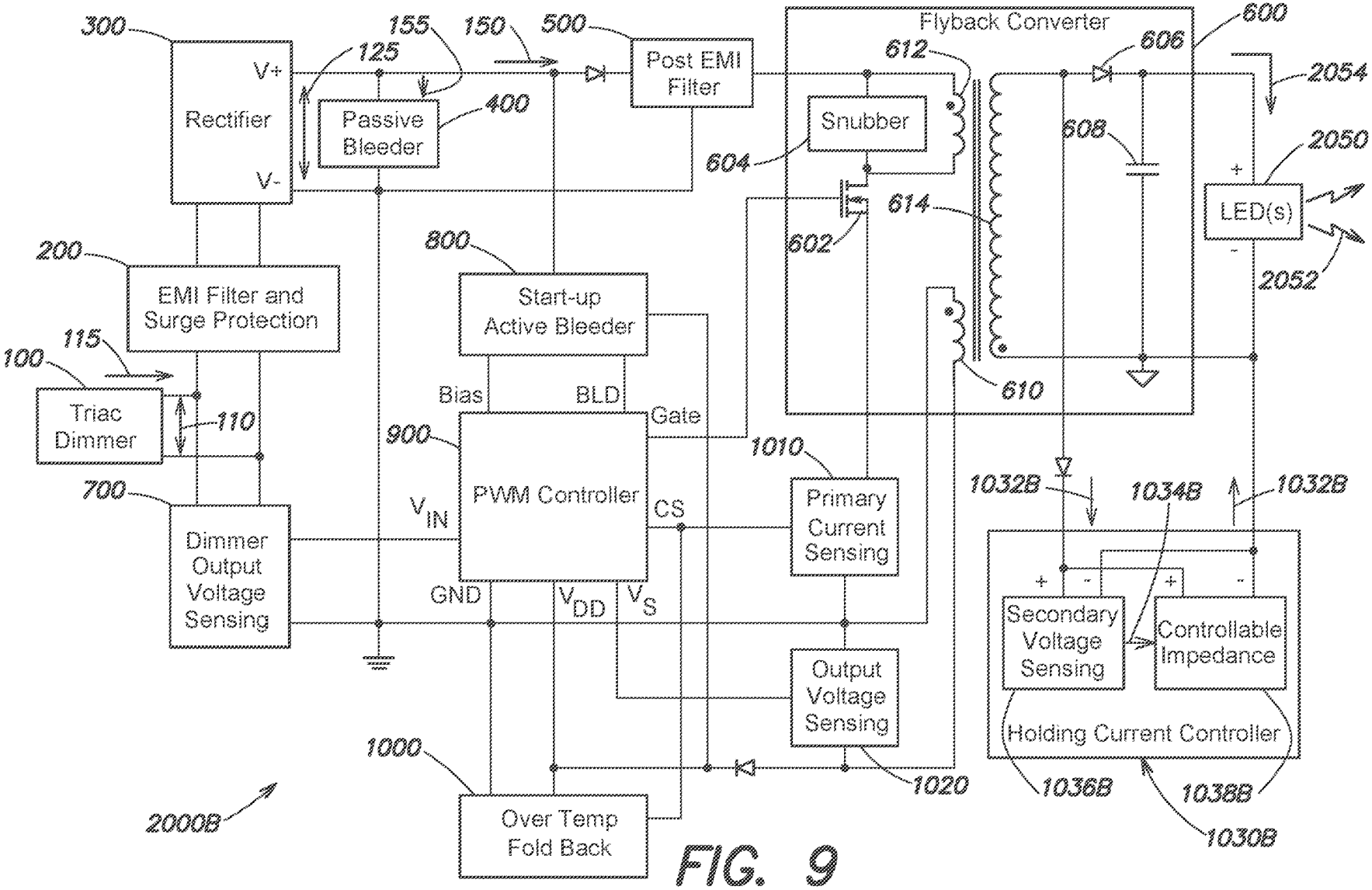
FIG. 9 is a block diagram of an LED controller comprising a secondary-side holding current controller to generate an adaptive holding current, according to another inventive implementation.

FIG. 9 is a block diagram of an LED controller 2000C comprising a secondary-side holding current controller 1030B to generate an adaptive holding current 1032B, according to another inventive implementation. The block diagram of the LED controller 2000C in FIG. 9 is similar in some respects to the LED controller 2000B shown in FIG. 7, and includes additional controller details and functionality that in some respects are similar to those discussed in connection with the conventional LED driver shown in FIGS. 4 and 5. For example, like this conventional LED driver, the LED controller 2000C includes an EMI filter and surge protection block 200, a passive bleeder 400 (to conduct passive bleeder current 155), a post EMI filter 500, and a start-up active bleeder 800. However, unlike the conventional LED driver shown in FIGS. 4 and 5, the LED controller 2000C of FIG. 9 includes an over temp fold back block 1000, and the secondary-side holding current controller 1030B.

More specifically, as shown in FIG. 9, the secondary side holding current controller 1030B includes a secondary-side voltage sensing circuit 1036B, coupled to the secondary winding 614 of the transformer, to provide a control voltage 1034B. The holding current controller 1030B also includes a controllable impedance 1038B, coupled to the secondary-side voltage sensing circuit, to provide a voltage-controlled resistive-like impedance based on the control voltage. In different aspects discussed in further detail below, the control voltage 1034B controls the controllable impedance 1038B to conduct the adaptive holding current 1032B when the triac-based dimmer 100 is adjusted such that the light output 2052 of the LED light source 2050 is approximately equal to or less than 5% of the full power light output of the LED light source, or more specifically less than 2% of the full power light output, or more specifically less than 1% of the full power light output (for some dimmers, this may correspond to a dimmer phase angle of approximately 100 degrees or less). In some implementations, the control voltage controls the controllable impedance to conduct the adaptive holding current when the triac-based dimmer is adjusted such that the light output of the LED light source is equal to or approximately 0.3% of the full power light output of the LED light source.

More generally, in FIG. 9, the control voltage 1034B controls the controllable impedance 1038B to conduct the adaptive holding current 1032B when the triac-based dimmer 100 is adjusted such that the light output 2052 of the LED light source 2050 is equal to or less than 5% of the full power light output of the LED light source, and greater than or equal to 0.3% of the full power light output of the LED light source. In this respect, the adaptive holding current causes the triac current $I_{TRIAC}$ 115 of the triac-based dimmer to be greater than a triac holding current $I_{HOLD}$ when the adjustment of the triac-based dimmer causes the light output of the LED light source to be equal to or less than 5% of the full power light output of the LED light source, and greater than or equal to 0.3% of the full power light output of the LED light source.

Figure 10:
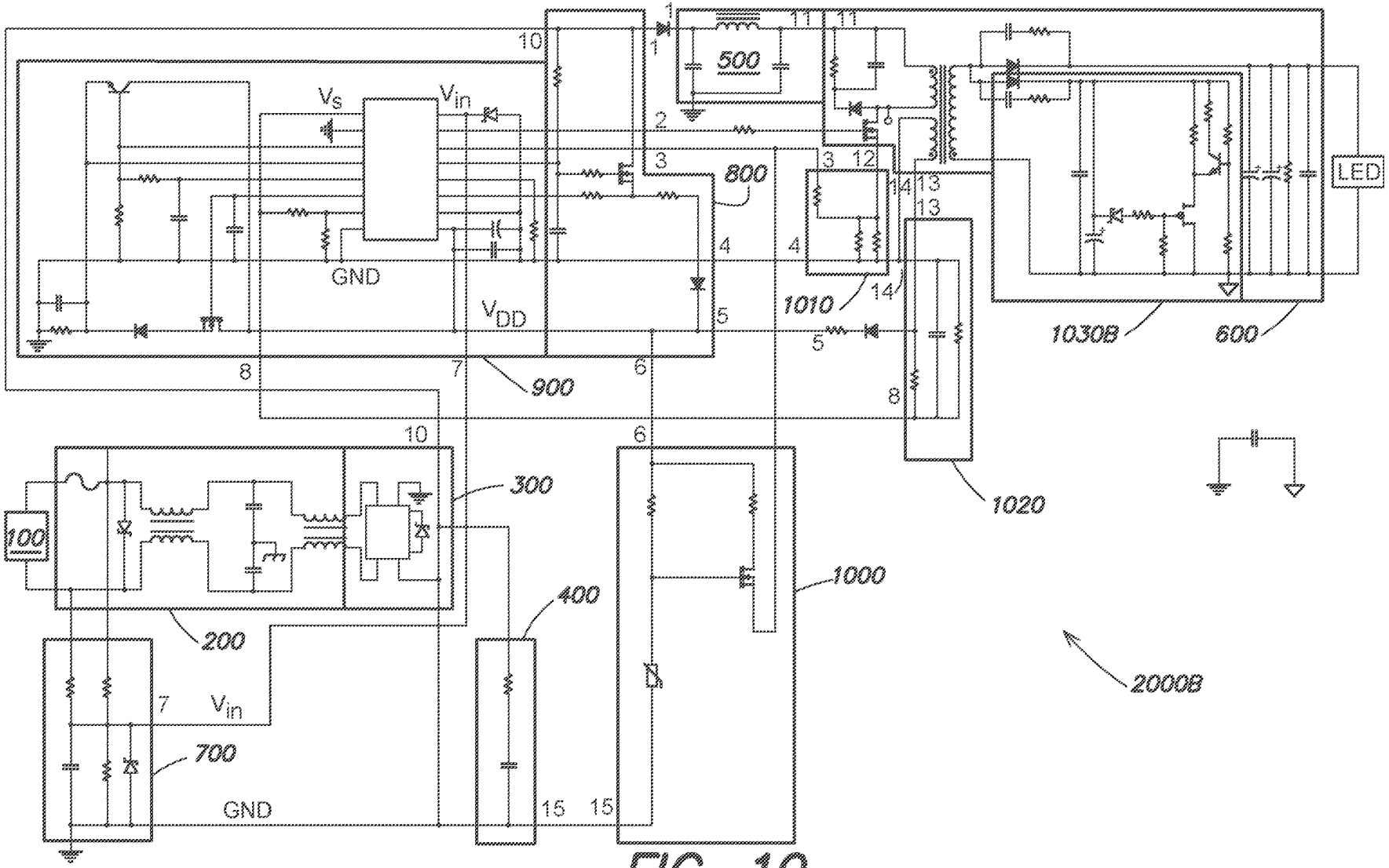
FIG. 10 is a circuit diagram for the inventive LED controller shown in FIG. 9, with the respective blocks of the block diagram of FIG. 9 overlaid on the corresponding circuit components of FIG. 10.

FIG. 10 is a circuit diagram for the inventive LED controller 2000C shown in FIG. 9, with the respective blocks of the block diagram of FIG. 9 overlaid on the corresponding circuit components of FIG. 10. The circuit of FIG. 10 employs the ON Semiconductor FL7734 integrated circuit. Specific details and exemplary component values for respective components of the circuit shown in FIG. 10 are provided in expanded circuit diagrams shown in FIGS. 11 through 14. In general, the circuit of FIG. 10 is designed for an AC line voltage of 120 $V_{RMS}$ (plus or minus 10%, i.e., 108-132 $V_{RMS}$), to provide a maximum power output to the LED light source 2050 of approximately 11.5 Watts (e.g., maximum output voltage of approximately 36 Volts and maximum output current 2054 of approximately 310 mA).

Figure 11:
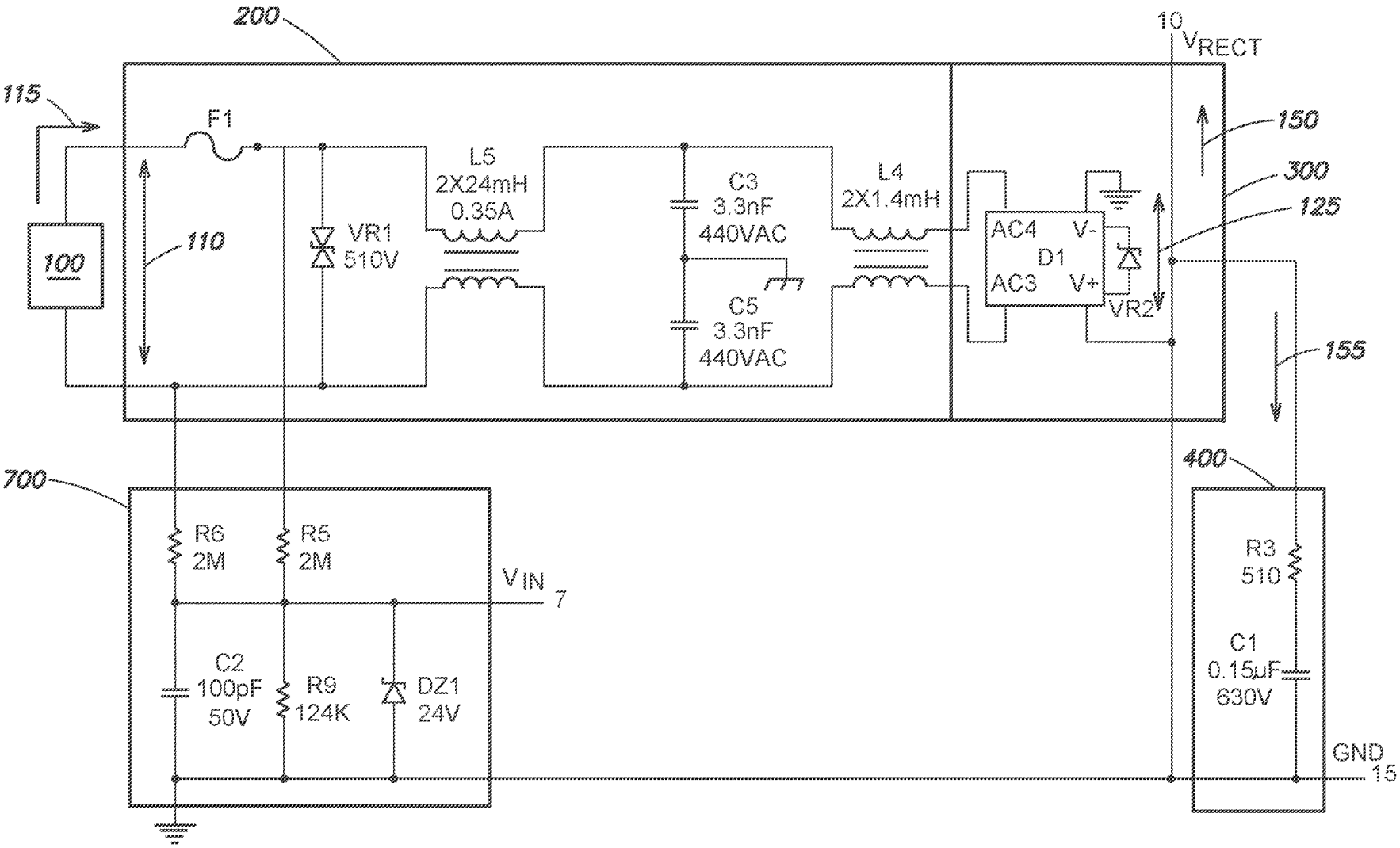
FIG. 11 is a circuit diagram for a first portion of the inventive circuit shown in FIG. 10, corresponding to an EMI filter and surge protection block, a rectifier block, a dimmer output voltage sensing block, and a passive bleeder block as shown in FIG. 9.

For example, FIG. 11 is a circuit diagram for a first portion of the inventive circuit shown in FIG. 10, corresponding to an EMI filter and surge protection block 200, a rectifier block 300, a dimmer output voltage sensing block 700, and a passive bleeder block 400 as shown in FIG. 9. In FIG. 11, the block 200 includes a fuse F1 to protect the LED controller under a fault condition (e.g., overcurrent). The block 200 also includes common mode inductor L4, differential mode inductors L1, L2, and Y type capacitors C3, C5 to attenuate common mode and differential mode noise from the switching circuit of the power converter 600 back to AC input line, for complying with FCC 15 class A for commercial products and class B for residential products. In this block, metal oxide varistor (MOV) VR1 and transient voltage suppressor (TVS) VR2 attenuate surges in the AC line voltage and electrical fast transients (EFT) to comply with IEC 61000-4-5 and IEC61000-4-4. In block 700, an RC averaging circuit provided by resistors R6, R5, R9 and C2 provide the dimmer output sampled voltage $V_{IN}$ that is applied to the PWC controller 900 (shown in FIG. 12). Transient voltage suppressor DZ1 protects against line surge and EFT coupling to the sampled voltage $V_{IN}$.

In block 400 of FIG. 11, R3 and C1 constitute a passive bleeder to provide passive bleeder current 155 to help maintain the triac current 115 above the triac holding current. As noted above, the passive bleeder block 400 provides a complex impedance that introduces power loss and some inefficiency in the controller 2000C; additionally, the passive bleeder current 155, while a helpful constituent of the overall current draw in the primary side of the LED controller from the triac-based dimmer, is by itself not sufficient to provide an adequate triac current above the triac holding current, particularly at appreciably deep dimming levels.

FIG. 12 is a circuit diagram for a second portion of the inventive circuit shown in FIG. 10, corresponding to a PWM controller block 900 and a start-up active bleeder block 800 as shown in FIG. 9. The PWM controller block 900 includes integrated circuit U1, which is the Fairchild/ON Semiconductor FL7734. Relevant details regarding the functionality of the blocks 900 and 800 may be found in the Fairchild/ON Semiconductor technical documentation entitled "FL7734 Single-Stage Primary-Side-Regulation PWM Controller for PFC and Phase Cut Dimmable LED Driving," Publication FL7734, Rev 1.0, dated November 2014, incorporated by reference herein.

In block 900, an active dimming loop implemented by the PWM controller is controlled by a voltage on pin 5 of U1 (DIM). The output current 2054 for the LED source 2050 (see FIG. 14) is constantly regulated due to the voltage at DIM being higher than 3 V in the closed loop mode. The output current 2054 is reduced as the phase angle of the triac-based dimmer is reduced; when the voltage at DIM reaches 2.25 V and the voltage at FB of U1 is clamped to the voltage at MOD, from resistor divider R11 and R10. In this case, the output LED current is determined by the voltage at MOD (proportional to phase angle) in an open loop mode. In one inventive aspect, Q1 and C4 are added to the block 900 to smooth the dimming curve during the transition between open loop mode and closed loop mode.

In the block 900 of FIG. 12, a maximum value for the sampled dimmer voltage $V_{IN}$ is approximately 24 V, a maximum value for a peak voltage at CS representing the sensed primary current is approximately 1.2 V, and a maximum value for the sensed voltage $V_S$ representing the secondary output voltage is approximately 6 V. As noted above, the auxiliary winding 610 of the transformer also provides an operating voltage VDD for the PWM controller 900 (a nominal value for VDD is in the range of 16-24V).

Figure 13:
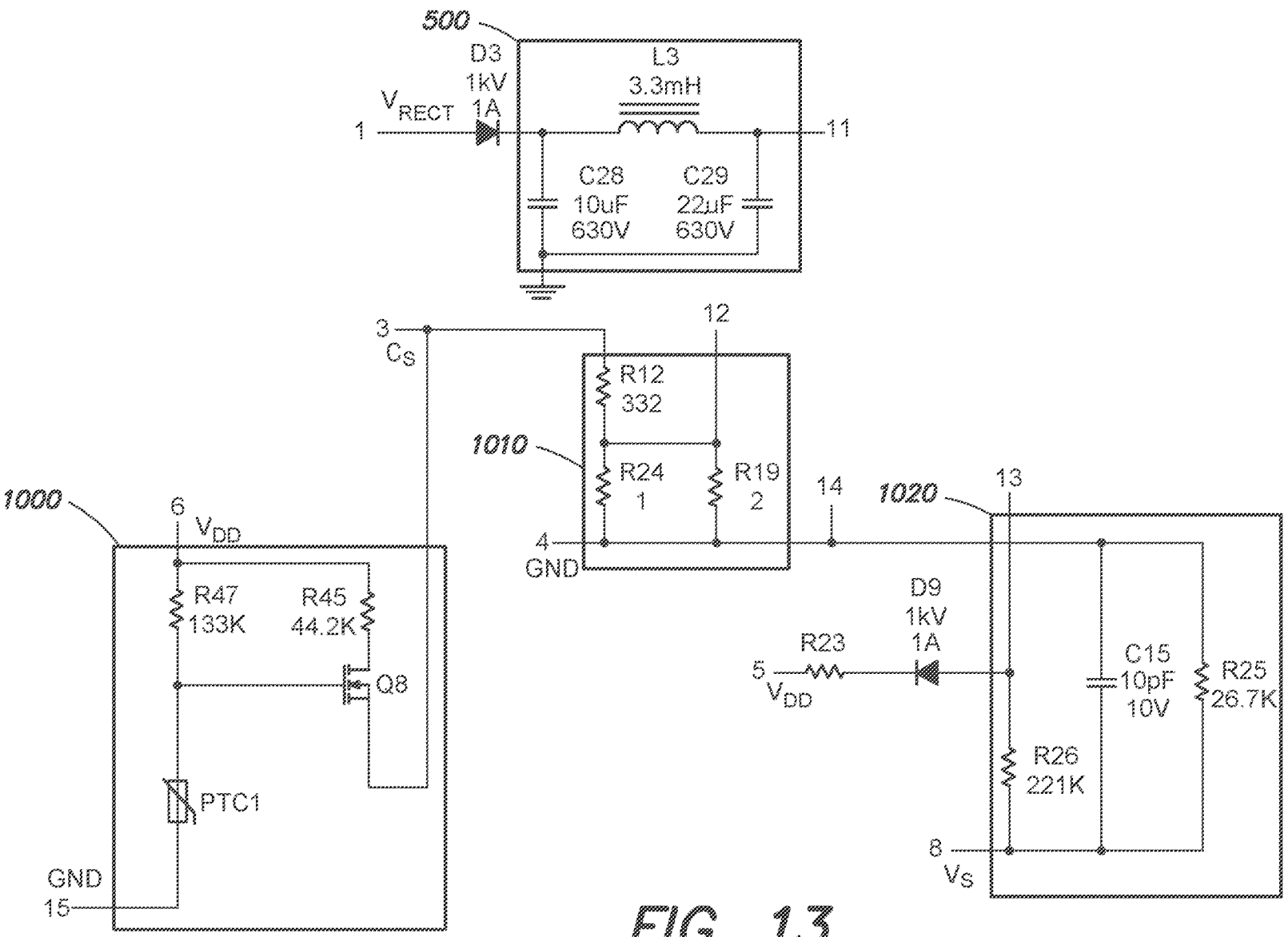
FIG. 13 is a circuit diagram for a third portion of the inventive circuit shown in FIG. 10, corresponding to a post EMI filter block, a primary current sensing block, an output voltage sensing block, and an over temp fold back block as shown in FIG. 9.

FIG. 13 is a circuit diagram for a third portion of the inventive circuit shown in FIG. 10, corresponding to a post EMI filter block 500, a primary current sensing block 1010, an output voltage sensing block 1020, and an over temperature fold back block 1000 as shown in FIG. 9. In block 500, the post EMI filter comprises C28, C29 and L3 π filter to attenuate higher switching frequency noise. The over temperature fold back circuit 1000 is formed by MOSFET Q8, positive temperature coefficient thermistor PTC1, and resistors R45 and R47. When the temperature of the LED controller rises from 25 degrees C. to 100 degrees C., the resistance of PTC1 increases from 470Ω to 47 KΩ. When PTC1 is 470Ω (relatively lower temperature), the voltage on the gate of Q8 is less than 2 V due to the voltage divider of R47 and PTC1, and Q8 is off (not conducting) (recall that VDD ranges between about 16-24V). With Q8 off, the current sense voltage CS is determined by the voltage divider of the primary current sensing circuit 1010, which allows for a maximum output current 2054 (e.g., around 310 mA). When PTC1 is 47 kΩ (relatively higher temperature), the voltage on the gate of Q8 is between 2-4 V and Q8 turns on to connect CS to $V_{DD}$ through R45. This results in nearly half of full output current (e.g., 155 mA) to thereby limit current in high temperature environments.

Figure 14:
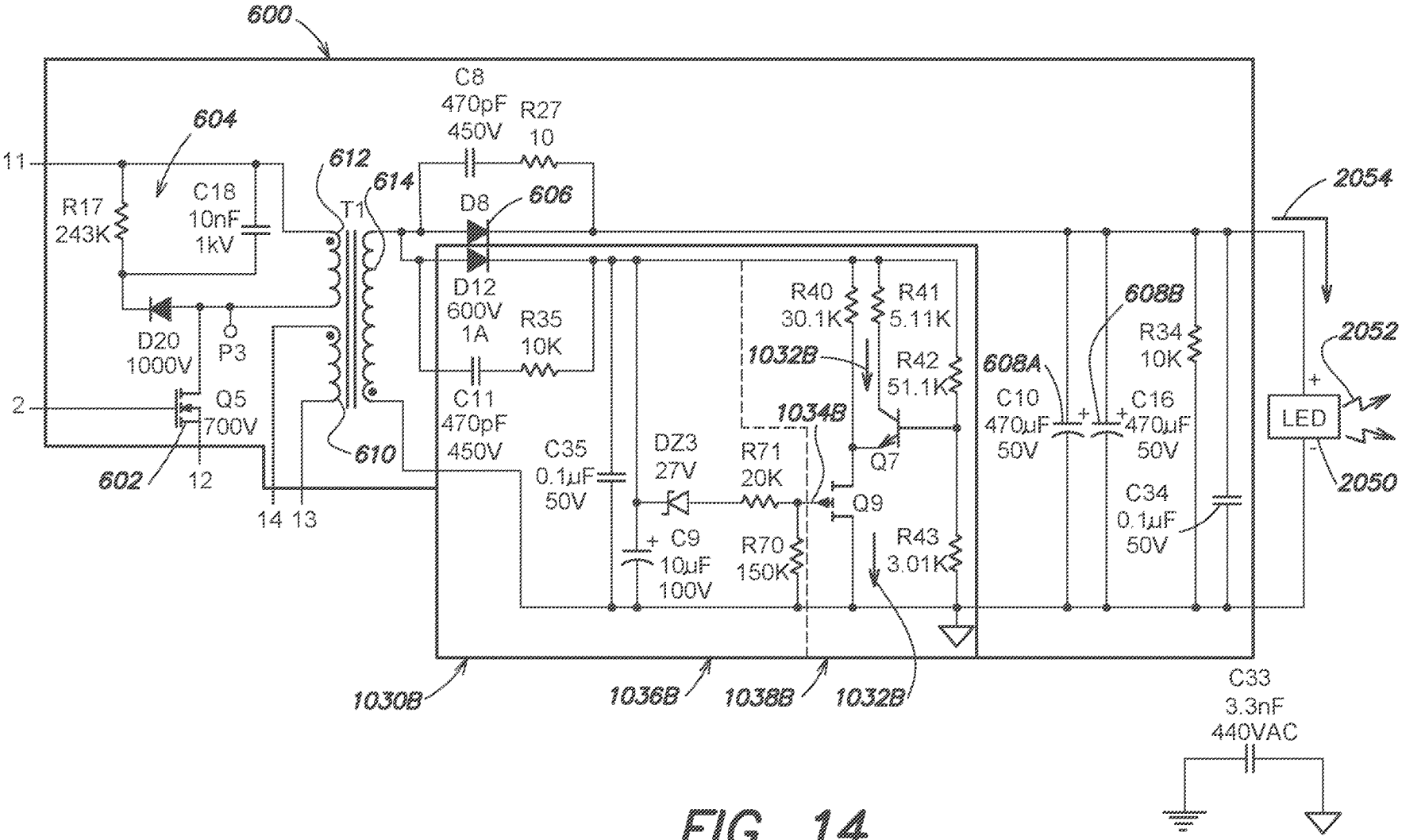
FIG. 14 is a circuit diagram for a fourth portion of the inventive circuit shown in FIG. 10, corresponding to a flyback converter block and a holding current controller block as shown in FIG. 9.

FIG. 14 is a circuit diagram for a fourth portion of the inventive circuit shown in FIG. 10, corresponding to a flyback converter block 600 and a holding current controller block 1030B as shown in FIG. 9. Regarding the transformer T1 of the flyback converter block 600, the primary winding 612 has 68 turns and an inductance of 0.5 mH, the secondary winding 614 has 34 turns, and the auxiliary winding 610 has 23 turns.

In FIG. 14, the holding current controller block 1030B quantitively controls an adaptive holding current 1032B, that is reflected to the primary side and constitutes a portion of the triac current 115; in particular, the adaptive holding current 1032B is relatively higher when the phase angle of the dimmer output 110 is relatively low under deep dimming mode (as the light output 2052 is decreased), and is gradually reduced to zero as the dimmer is adjusted (increased phase angle) to increase the light output 2052. This adaptive holding current enables the LED controller's capability to dim down to less than 5%, and more specifically less than 2%, and more specifically less than 1%, and more specifically 0.3% or less of full power light output, as well as the capability to turn the light output on at 5%, 2%, 1%, or 0.3% dimming level.

The secondary-side voltage sensing block 1036B includes a capacitor C9 coupled to the secondary winding to provide a sampled secondary voltage (having a range of from approximately 25 V to 50 V). Zener diode DZ3 (27 V) is coupled to the capacitor C9 to provide a reduced sampled secondary voltage and limit this sample voltage. Resistor network R70 and R71 are coupled to the Zener diode to provide a control voltage 1034B to the controllable impedance block 1038B.

The controllable impedance block 1038B includes junction field-effect transistor (JFET) Q9 and buffer transistor Q7, coupled to the JFET. The buffer transistor Q7 provides a current path for at least a portion of the adaptive holding current 1032B through both of the buffer transistor and the JFET when the control voltage 1034B biases the JFET to provide a relatively low impedance. The buffer transistor Q7 also limits a drain-source voltage of the JFET Q9 to protect the JFET from an over-voltage condition when the control voltage 1034B biases the JFET to provide a relatively high impedance and thereby significantly reduce the adaptive holding current 1032B.

More specifically, the control voltage on the gate of JFET Q9 is proportional to the average rectified dimmer output voltage 125. In block 1036B of FIG. 14, DZ3 clamps Vgs of Q9 to be less than its rated voltage (e.g., maximum 40 V). In block 1038B, R40, R41 and R42 are pull up resistors and R70 and R43 are pull down resistors to provide proper operating parameters for the transistors Q9 and Q7. The resistance of the drain-source channel of the JFET Q9 is a function of the gate-source voltage Vgs of the JFET, which behaves as an almost pure ohmic resistor. When Vgs of the JFET is equal to zero volts, the drain-source resistance of the JFET is minimum. If the Vgs is increased, this resistance also increases until the JFET is no longer conductive. In some implementations, the low resistive-like impedance reflected to the primary increases the triac current 115 when the dimmer phase angle is in a range of from approximately 30 degrees to 100 degrees. When the dimmer phase angle is higher, the JFET Q9 is not conductive and there is no adaptive holding current 1032B. Thus, the impedance provided by the JFET is adaptive and resistive; it is unlike the RC passive bleeder circuit 400 (which appears as a capacitive load to the dimmer 100). In the example shown in FIG. 14, the maximum adaptive holding current 1032B ranges from approximately 4 mA to approximately 7 mA.

In block 600, near the output provided to the LED source 2050, C10, C16 and C34 are output capacitors to filter voltage ripple and noise spikes on LED load. C33, a Y-type capacitor, is a bridge to link primary side ground and the secondary side ground for higher frequency path.

Conclusion

All parameters, dimensions, materials, and configurations described herein are meant to be exemplary and the actual parameters, dimensions, materials, and/or configurations will depend upon the specific application or applications for which the inventive teachings is/are used. It is to be understood that the foregoing embodiments are presented primarily by way of example and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, various inventive concepts may be embodied as one or more methods, of which at least one example has been provided. The acts performed as part of the method may in some instances be ordered in different ways. Accordingly, in some inventive implementations, respective acts of a given method may be performed in an order different than specifically illustrated, which may include performing some acts simultaneously (even if such acts are shown as sequential acts in illustrative embodiments).

The use of a numerical range does not preclude equivalents that fall outside the range that fulfill the same function, in the same way, to produce the same result.

All publications, patent applications, patents, and other references mentioned herein are incorporated by reference in their entirety.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An LED controller to control a light output of an LED light source in response to a dimmer output of a triac-based dimmer, the LED controller comprising:

a rectifier to provide a rectified voltage based on the dimmer output of the triac-based dimmer;

a flyback converter comprising:

a transformer comprising:

a primary winding coupled to the rectified voltage; and a secondary winding;

a controllable switch coupled to the primary winding to control a primary winding current through the primary winding; and a diode and at least one capacitor coupled to the secondary winding to provide output power for the LED light source based at least in part on the triac-based dimmer output and the primary winding current;

a pulse width modulation (PWM) controller to control the controllable switch of the flyback converter; and a holding current controller, coupled to one of the primary winding and the secondary winding of the transformer of the flyback converter, wherein:

the holding current controller includes a voltage-controlled impedance to provide an adaptive holding current for the triac-based dimmer; and the voltage-controlled impedance is not pulse width modulated.

2. The LED controller of claim 1, wherein the adaptive holding current provided by the holding current controller causes a triac current ($I_{TRIAC}$) of the triac-based dimmer to be approximately equal to or greater than a triac holding current ($I_{HOLD}$) of the triac-based dimmer as the triac-based dimmer is adjusted to control the light output of the LED light source.

3. The LED controller of claim 2, wherein:

the holding current controller is controlled by an input voltage representing the dimmer output of the triac-based dimmer;

the voltage-controlled impedance increases as the input voltage increases so as to reduce the adaptive holding current; and the voltage-controlled impedance decreases as the input voltage decreases so as to increase the adaptive holding current.

4. The LED controller of claim 3, wherein:

the triac-based dimmer is adjustable to provide a full power light output of the LED light source at a maximum value of the dimmer output; and the adaptive holding current causes the triac current ($I_{TRIAC}$) to be greater than the triac holding current ($I_{HOLD}$) when the triac-based dimmer is adjusted to cause the light output of the LED light source to be less than 5% of the full power light output of the LED light source.

5. The LED controller of claim 4, wherein the adaptive holding current causes the triac current ($I_{TRIAC}$) to be greater than the triac holding current ($I_{HOLD}$) when the triac-based dimmer is adjusted to increase the light output of the LED light source from less than 5% of the full power light output of the LED light source to greater than 5% of the full power light output of the LED light source.

6. The LED controller of claim 4, wherein the adaptive holding current causes the triac current ($I_{TRIAC}$) to be greater than the triac holding current ($I_{HOLD}$) when the triac-based dimmer is adjusted to cause the light output of the LED light source to be less than 2% of the full power light output of the LED light source.

7. The LED controller of claim 6, wherein the adaptive holding current causes the triac current ($I_{TRIAC}$) to be greater than the triac holding current ($I_{HOLD}$) when the triac-based dimmer is adjusted to increase the light output of the LED light source from less than 2% of the full power light output of the LED light source to greater than 2% of the full power light output of the LED light source.

8. The LED controller of claim 6, wherein the adaptive holding current causes the triac current ($I_{TRIAC}$) to be greater than the triac holding current ($I_{HOLD}$) when the triac-based dimmer is adjusted to cause the light output of the LED light source to be less than 1% of the full power light output of the LED light source.

9. The LED controller of claim 8, wherein the adaptive holding current causes the triac current ($I_{TRIAC}$) to be greater than the triac holding current ($I_{HOLD}$) when the triac-based dimmer is adjusted to increase the light output of the LED light source from less than 1% of the full power light output of the LED light source to greater than 1% of the full power light output of the LED light source.

10. The LED controller of claim 1, wherein:

the holding current controller is coupled to the secondary winding of the transformer of the flyback converter; and the voltage-controlled impedance is reflected to the primary winding of the transformer to thereby provide the adaptive holding current for the triac-based dimmer.

11. The LED controller of claim 10, wherein the holding current controller comprises:

a secondary-side voltage sensing circuit, coupled to the secondary winding of the transformer, to provide a control voltage; and a controllable impedance, coupled to the secondary-side voltage sensing circuit, to provide the voltage-controlled impedance based on the control voltage.

12. The LED controller of claim 11, wherein:

the triac-based dimmer is adjustable to provide a full power light output of the LED light source at a maximum value of the dimmer output; and the control voltage controls the controllable impedance to conduct the adaptive holding current when the triac-based dimmer is adjusted such that the light output of the LED light source is approximately equal to or less than 5% of the full power light output of the LED light source.

13. The LED controller of claim 12, wherein the control voltage controls the controllable impedance to conduct the adaptive holding current when the dimmer output of the triac-based dimmer has a phase angle of approximately equal to or less than 100 degrees.

14. The LED controller of claim 12, wherein the control voltage controls the controllable impedance to conduct the adaptive holding current when the triac-based dimmer is adjusted such that the light output of the LED light source is equal to or less than 2% of the full power light output of the LED light source.

15. The LED controller of claim 14, wherein the control voltage controls the controllable impedance to conduct the adaptive holding current when the triac-based dimmer is adjusted such that the light output of the LED light source is equal to or less than 1% of the full power light output of the LED light source.

16. The LED controller of claim 15, wherein the control voltage controls the controllable impedance to conduct the adaptive holding current when the triac-based dimmer is adjusted such that the light output of the LED light source is equal to or approximately 0.3% of the full power light output of the LED light source.

17. The LED controller of claim 12, wherein the control voltage controls the controllable impedance to conduct the adaptive holding current when the triac-based dimmer is adjusted such that the light output of the LED light source is equal to or less than 5% of the full power light output of the LED light source, and greater than or equal to 0.3% of the full power light output of the LED light source.

18. The LED controller of claim 17, wherein the adaptive holding current causes a triac current ($I_{TRIAC}$) (115) of the triac-based dimmer to be greater than a triac holding current ($I_{HOLD}$) (120) of the triac-based dimmer when the adjustment of the triac-based dimmer causes the light output of the LED light source to be equal to or less than 5% of the full power light output of the LED light source, and greater than or equal to 0.3% of the full power light output of the LED light source.

19. The LED controller of claim 17, wherein the control voltage controls the controllable impedance to conduct the adaptive holding current when the dimmer output of the triac-based dimmer has a phase angle of between approximately 100 degrees and approximately 30 degrees.

20. The LED controller of claim 11, wherein the controllable impedance does not include a metal-oxide semiconductor field-effect transistor (MOSFET).

21. An LED controller to control a light output of an LED light source in response to a dimmer output of a triac-based dimmer, the LED controller comprising:

a rectifier to provide a rectified voltage based on the dimmer output of the triac-based dimmer;

a transformer comprising a primary winding coupled to the rectified voltage, and a secondary winding;

a holding current controller coupled to the secondary winding of the transformer, the holding current controller comprising:

a secondary-side voltage sensing circuit, coupled to the secondary winding of the transformer, to provide a control voltage; and a controllable impedance, coupled to the secondary-side voltage sensing circuit, to provide a voltage-controlled impedance based on the control voltage, wherein:

the controllable impedance comprises a junction field-effect transistor (JFET) (Q9); and the voltage-controlled impedance provides an adaptive holding current for the triac-based dimmer.

22. The LED controller of claim 21, wherein the controllable impedance further comprises a buffer transistor (Q7), coupled to the JFET, to:

provide a current path for at least a portion of the adaptive holding current through both of the buffer transistor and the JFET when the control voltage biases the JFET to provide a relatively low impedance; and limit a drain-source voltage of the JFET to protect the JFET from an over-voltage condition when the control voltage biases the JFET to provide a relatively high impedance and thereby significantly reduce the adaptive holding current.

23. The LED controller of claim 22, wherein the secondary-side voltage sensing circuit comprises:

a capacitor (C9) coupled to the secondary winding to provide a sampled secondary voltage;

a Zener diode (DZ3) coupled to the capacitor to provide a reduced sampled secondary voltage; and a resistor network (R70, R71), coupled to the Zener diode and the JFET, to provide the control voltage to the JFET.

24. The LED controller of claim 23, wherein the controllable impedance further comprises a buffer transistor (Q7), coupled to the JFET, to:

provide a current path for at least a portion of the adaptive holding current through both of the buffer transistor and the JFET when the control voltage biases the JFET to provide a relatively low impedance; and limit a drain-source voltage of the JFET to protect the JFET from an over-voltage condition when the control voltage biases the JFET to provide a relatively high impedance and thereby significantly reduce the adaptive holding current.

25. An LED driver to increase or reduce light output from an LED light source in response to adjustment of a triac-based dimmer coupled to the LED driver, the LED driver comprising:

a rectifier to provide a rectified voltage based on a dimmer output of the triac-based dimmer;

a power converter, coupled to the rectifier, to provide output power for the LED light source based at least in part on the rectified voltage; and an impedance generation circuit, coupled to the power converter, to generate a voltage-controlled resistive-like impedance to provide an adaptive holding current for the triac-based dimmer, wherein:

the impedance generation circuit is controlled by an input voltage representing the dimmer output of the triac-based dimmer;

the voltage-controlled resistive-like impedance increases as the input voltage increases so as to reduce the adaptive holding current;

the voltage-controlled resistive-like impedance decreases as the input voltage decreases so as to increase the adaptive holding current; and the adaptive holding current causes a triac current ($I_{TRIAC}$) of the triac-based dimmer to be greater than a triac holding current ($I_{HOLD}$) of the triac-based dimmer.

26. The LED controller of claim 25, wherein:

the triac-based dimmer is adjustable to provide a full power light output of the LED light source at a maximum value of the dimmer output; and the adaptive holding current causes the triac current ($I_{TRIAC}$) to be greater than the triac holding current ($I_{HOLD}$) when the triac-based dimmer is adjusted to cause the light output of the LED light source to be less than 5% of the full power light output of the LED light source.

27. The LED controller of claim 26, wherein the adaptive holding current causes the triac current ($I_{TRIAC}$) to be greater than the triac holding current ($I_{HOLD}$) when the triac-based dimmer is adjusted to cause the light output of the LED light source to be less than 2% of the full power light output of the LED light source.

28. The LED controller of claim 27, wherein the adaptive holding current causes the triac current ($I_{TRIAC}$) to be greater than the triac holding current ($I_{HOLD}$) when the triac-based dimmer is adjusted to increase the light output of the LED light source from less than 2% of the full power light output of the LED light source to greater than 2% of the full power light output of the LED light source.

29. The LED controller of claim 27, wherein the adaptive holding current causes the triac current ($I_{TRIAC}$) to be greater than the triac holding current ($I_{HOLD}$) when the triac-based dimmer is adjusted to cause the light output of the LED light source to be less than 1% of the full power light output of the LED light source.

30. The LED controller of claim 29, wherein the adaptive holding current causes the triac current ($I_{TRIAC}$) to be greater than the triac holding current ($I_{HOLD}$) when the triac-based dimmer is adjusted to increase the light output of the LED light source from less than 1% of the full power light output of the LED light source to greater than 1% of the full power light output of the LED light source.

* * * * *